US005112716A

United States Patent [19]

Kato et al.

[11] Patent Number: 5,112,716

[45] Date of Patent: * May 12, 1992

[54] LIQUID DEVELOPER FOR ELECTROSTATIC PHOTOGRAPHY

[75] Inventors: Eiichi Kato; Hideyuki Hattori, both of Haibara, Japan

[73] Assignee: Fuji Photo Film Co., Ltd., Kanagawa, Japan

[ * ] Notice: The portion of the term of this patent subsequent to Apr. 9, 2008 has been disclaimed.

[21] Appl. No.: 507,535

[22] Filed: Apr. 11, 1990

[30] Foreign Application Priority Data

| | | | |
|---|---|---|---|
| Apr. 12, 1989 | [JP] | Japan | 1-90550 |
| May 17, 1989 | [JP] | Japan | 1-121406 |
| May 18, 1989 | [JP] | Japan | 1-122835 |

[51] Int. Cl.[5] ..... G03G 9/00; G03G 9/12

[52] U.S. Cl. ..... 430/114; 430/115; 430/904

[58] Field of Search ..... 430/114, 115

[56] References Cited

U.S. PATENT DOCUMENTS

| | | | |
|---|---|---|---|
| 4,618,557 | 10/1986 | Dan et al. | 430/114 |
| 4,665,002 | 5/1987 | Dan et al. . | |
| 4,837,102 | 6/1989 | Dan et al. | 430/114 |
| 4,840,865 | 6/1989 | Kato et al. | 430/114 |
| 4,842,975 | 6/1989 | Kato et al. . | |
| 5,006,441 | 4/1991 | Kato | 430/114 |

FOREIGN PATENT DOCUMENTS

| | | |
|---|---|---|
| 0376650 | 7/1990 | European Pat. Off. . |
| 3730288 | 3/1988 | Fed. Rep. of Germany . |

OTHER PUBLICATIONS

Patent Abstracts of Japan, vol. 10, No. 38 (Feb. 14, 1986).

*Primary Examiner*—Marion E. McCamish
*Assistant Examiner*—Stephen Crassan
*Attorney, Agent, or Firm*—Sughrue, Mion, Zinn, Macpeak & Seas

[57] ABSTRACT

A liquid developer for electrostatic photography is disclosed. The liquid developer comprises at least resin grains dispersed in a non-aqueous solvent having an electric resistance of at least $10^9$ Ωcm and a dielectric constant of not higher than 3.5, wherein the dispersed resin grains are polymer resin grains obtained by polymerizing a solution containing (1) at least a mono-functional monomer (A) which is soluble in the aforesaid non-aqueous solvent but becomes insoluble therein by being polymerized in the presence of a dispersion-stabilizing resin (BA) soluble in the non-aqueous solvent, which is a polymer containing a recurring unit represented by the formula (I) described in the specification, at least a part of the main chain of the polymer being crosslinked, and, optionally, (2) a monomer (B-1) represented by the formula (II-1) described in the specification. The liquid developer of this invention is excellent in re-dispersibility, storability, stability, image-reproducibility, and fixability.

9 Claims, No Drawings

LIQUID DEVELOPER FOR ELECTROSTATIC PHOTOGRAPHY

FIELD OF THE INVENTION

This invention relates to a liquid developer for electrophotography, which comprises resin grains dispersed in a liquid carrier having an electric resistance of at least $10^9$ Ωcm and a dielectric constant of not higher than 3.5, and more particularly to an electrophotographic liquid developer excellent in redispersibility, storability, stability, image-reproducibility, and fixability.

BACKGROUND OF THE INVENTION

In general, a liquid developer for electrophotography is prepared by dispersing an inorganic or organic pigment or dye such as carbon black, nigrosine, phthalocyanine blue, etc., a natural or synthetic resin such as an alkyd resin, an acrylic resin, rosine, synthetic rubber, etc., in a liquid having a high electric insulating property and a low dielectric constant, such as a petroleum aliphatic hydrocarbon, etc., and further adding a polarity-controlling agent such as a metal soap, lecithin, linseed oil, a higher fatty acid, a vinyl pyrrolidone-containing polymer, etc., to the resulting dispersion.

In such a developer, the resin is dispersed in the form of insoluble latex grains having a grain size of from several nm to several hundred nm. In a conventional liquid developer, however, a soluble dispersion-stabilizing resin added to the liquid developer and the polarity-controlling agent are insufficiently bonded to the insoluble latex grains, thereby the soluble dispersion-stabilizing resin and the polarity-controlling agent are in a state of easily dispersing in the liquid carrier. Accordingly, there is a fault that when the liquid developer is stored for a long period of time or repeatedly used, the dispersion-stabilizing resin is split off from the insoluble latex grains, thereby the latex grains are precipitated, aggregated, and accumulated to make the polarity thereof indistinct. Also, since the latex grains once aggregated or accumulated are reluctant to re-disperse, the latex grains remain everywhere in the developing machine attached thereto, which results in causing stains of images formed and malfunctions of the developing machine, such as clogging of a liquid feed pump, etc.

For overcoming such defects, a means of chemically bonding the soluble dispersion-stabilizing resin and the insoluble latex grains is disclosed in U.S. Pat. No. 3,990,980. However, the liquid developer disclosed therein is still insufficient although the dispersion stability of the grains to the spontaneous precipitation may be improved to some extent. Also, when the liquid developer is actually used in a developing apparatus, the toner adhered to parts of the developing apparatus solidified to form a film and the toner grains thus solidified are reluctant to redisperse and are insufficient in re-dispersion stability for practical use, which causes the malfunction of the apparatus and staining of duplicated images.

In the method of producing resin grains described in aforesaid U.S. Pat. No. 3,990,980, there is a very severe restriction in the combination of a dispersion stabilizer to be used and monomer(s) being insolubilized for producing mono-dispersed latex grains having a narrow grain size distribution. Mostly, the resin grains produced by the aforesaid method are grains of a broad grain size distribution containing a large amount of coarse grains or poly-dispersed grains having two or more different mean grain sizes. In the aforesaid method, it is difficult to obtain mono-dispersed resin grains having a narrow grain size distribution and having a desired grain size, and the method often results in forming large grains having a mean grain size of 1 μm or larger or very fine grains having a mean grain size of 0.1 μm or smaller. Furthermore, there is also a problem that the dispersion stabilizer used must be prepared by an extremely complicated process requiring a long reaction time.

Furthermore, for overcoming the aforesaid defects, a method of improving the dispersibility, redispersibility and storage stability of resin grains by forming insoluble dispersed resin grains by polymerizing a monomer being insolubilized in the presence of a polymer utilizing a di-functional monomer or a polymer utilizing a macromolecular reaction is disclosed in JP-A-60-185962 and JP-A-61-43757 (the term "JP-A" as used herein means an "unexamined published Japanese patent application").

On the other hand, a noticiable progress has recently been made in shortening the operation time in an electrophotomechanical system and an improvement of quickening a development-fix steps in the system has been made.

Also, the rationalization of an electrophotomechanical system has been greatly required and practically, it has been attempted to prolong the maintenance time of a printing plate making machine. In this attempt, a liquid developer which can be used for a long period of time without being renewed has been required.

The dispersed resin grains produced by the methods disclosed in aforesaid JP-A-60-185962 and JP-A-61-43757 yet show an unsatisfactory performance with respect to the dispersibility and re-dispersibility of the resin grains in the case of increasing the development speed.

SUMMARY OF THE INVENTION

This invention has been made for solving the aforesaid problems inherent to conventional electrophotographic liquid developers.

An object of this invention, is to provide a liquid developer excellent in dispersion stability, redispersibility, and fixing property in an electrophotomechanical system wherein the development-fix steps are quickened and the maintenance time thereof is prolonged.

Another object of this invention is to provide a liquid developer capable of forming an offset printing master plate having excellent receptivity for printing ink and printing durability by an electrophotography.

A further object of this invention is provided a liquid developer suitable for various electrostatic photographies and various transfer systems in addition to the aforesaid uses.

A still further object of this invention is to provide a liquid developer capable of being used for any liquid developer-using systems such as ink jet recording, cathode ray tube recording, and recording by pressure variation or electrostatic variation.

The aforesaid objects have been attained by the present invention as described hereinafter in detail.

That is, the present invention provides a liquid developer for electrostatic photography comprising at least resin grains dispersed in a non-aqueous solvent having an electric resistance of at least $10^9$ Ωcm and a dielectric constant of not higher than 3.5, wherein the dispersed resin grains are polymer resin grains obtained by polymerizing a solution containing at least a monofunctional monomer (A) which is soluble in the aforesaid non-aqueous solvent but becomes insoluble therein by being polymerized in the presence of a dispersion stabilizing resin (BA) soluble in the non-aqueous solvent, which is a polymer containing a recurring unit represented by the following formula (I), at least a part of the main chain of the polymer being crosslinked;

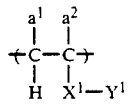

(I)

wherein $X^1$ represents —COO—, —OCO—, —$CH_2$OCO—, —$CH_2$COO—, —O—, or —$SO_2$—; $Y^1$ represents an aliphatic group having from 6 to 32 carbon atoms; and $a^1$ and $a^2$, which may be the same or different, each represents a hydrogen atom, a halogen atom, a cyano group, a hydrocarbon group having from 1 to 8 carbon atoms, —COO—$Z^1$ or —COO—$Z^1$ bonded via a hydrocarbon group having from 1 to 8 carbon atoms (wherein $Z^1$ represents a hydrocarbon group having from 1 to 22 carbon atoms).

DETAILED DESCRIPTION OF THE INVENTION

Then, the liquid developer of this invention is described in detail.

As the liquid carrier for the liquid developer of this invention having an electric resistance of at least $10^9$ Ωcm and a dielectric constant of not higher than 3.5, straight chain or branched aliphatic hydrocarbons, alicyclic hydrocarbons, aromatic hydrocarbons, and halogen-substituted derivatives thereof can be used. Examples of liquid carrier include octane, isooctane, decane, isodecane, decalin, nonane, dodecane, isododecane, cyclohexane, cyclooctane, cyclodecane, benzene, toluene, xylene, mesitylene, Isopar E, Isopar G, Isopar H, Isopar L (Isopar: trade name of Exxon Co.), Shellsol 70, Shellsol 71 (Shellsol: trade name of Shell Oil Co.), Amsco OMS and Amsco 460 solvent (Amsco: trade name of Americal Mineral Spirits Co.). They may be used singly or as a combination thereof.

The non-aqueous dispersed resin grains (hereinafter, often referred to as "dispersion resin grains" or "latex grains") which are the most important constituting element in this invention are resin grains produced by polymerizing (so-called polymerization granulation method), in a non-aqueous solvent, the aforesaid monofunctional monomer (A) in the presence of a dispersion-stabilizing resin soluble in the non- o aqueous solvent, said dispersion-stabilizing resin being a polymer containing at least a recurring unit represented by the aforesaid formula (I), a part of which has been crosslinked.

As the non-aqueous solvent for use in this invention, any solvents miscible with the aforesaid liquid carrier for the liquid developer for electrostatic photography can be basically used in this invention.

That is, the non-aqueous solvent used in the production of the dispersion resin grains may be any solvent miscible with the aforesaid liquid carrier, and preferably includes straight chain or branched aliphatic hydrocarbons, alicyclic hydrocarbons, aromatic hydrocarbons, and halogen-substituted derivatives thereof.

Specific examples thereof are hexane, octane, isooctane, decane, isodecane, decalin, nonane, isododecane, Isopar E, Isopar G, Isopar H, Isopar L, Shellsol 70, Shellsol 71, Amsco OMS, and Amsco 460. These solvents may be used singly or as a combination thereof.

Other solvents can be used together with the aforesaid organic solvents for the production of the non-aqueous dispersion resin grains and examples thereof include alcohols (e.g., methanol, ethanol, propyl alcohol, butyl alcohol, and fluorinated alcohols), ketones (e.g., acetone, methyl ethyl ketone, and cyclohexanone), carboxylic acid esters (e.g., methyl acetate, ethyl acetate, propyl acetate, butyl acetate, methyl propionate, and ethyl propionate), ethers (e.g., diethyl ether, dipropyl ether, tetrahydrofuran, and dioxane), and halogenated hydrocarbons (e.g., methylene dichloride, chloroform, carbon tetrachloride, dichloroethane, and methylchloroform).

It is preferred that the non-aqueous solvents which are used as a mixture thereof are distilled off by heating or under a reduced pressure after completion of the polymerization granulation. However, even when the solvent is brought in the liquid developer as a latex grain dispersion, the solvent gives no problem if the liquid electric resistance of the liquid developer is in the range of satisfying the condition of at least $10^9$ Ωcm.

In general, it is preferred that the same solvent as the liquid carrier is used in the step of forming the resin dispersion and, as such a solvent, there are straight chain or branched aliphatic hydrocarbons, alicyclic hydrocarbons, aromatic hydrocarbons, halogenated hydrocarbons, etc., as described above.

The dispersion stabilizing resin of this invention, which is used for forming a stable resin dispersion, is a polymer soluble in the non-aqueous solvent and having the recurring unit shown by aforesaid formula (I), a part of the polymer chain of which having been crosslinked.

Then, the recurring unit shown by formula (I) is described in detail.

In the recurring unit shown by aforesaid formula (I), the aliphatic group and the hydrocarbon group may be substituted.

In formula (I) described above, $X^1$ represents preferably —COO—, —OCO—, —$CH_2$OCO—, —$CH_2$COO—, or —O—, and is more preferably —COO—, —$CH_2$COO—, or —O—.

$Y^1$ in the formula represents preferably an alkyl group, an alkenyl group, or an aralkyl group each having from 8 to 22 carbon atoms and each may have a substituent. Examples of the substituent include a halogen atom (e.g., fluorine, chlorine, and bromine), —O—$Z^2$, —COO—$Z^2$, and —OCO—$Z^2$ (wherein $Z^2$ represents an alkyl group having from 6 to 22 carbon atoms, for example, hexyl, octyl, decyl, dodecyl, hexadecyl, and octadecyl).

$Y^1$ represents more preferably an alkyl group or an alkenyl group each having from 8 to 22 carbon atoms, for example, octyl, decyl, dodecyl, hexadecyl, octadecyl, docosanyl, octenyl, decenyl, dodecenyl, tetradecenyl, hexadecenyl, and octadecenyl.

In the formula (I), $a^1$ and $a^2$, which may be the same or different, each represents preferably a hydrogen atom, a halogen atom (e.g., fluorine, chlorine, and bromine), a cyano group, an alkyl group having from 1 to 3 carbon atoms, —COO—$Z^3$, or —$CH_2$COO—$Z^3$ wherein $Z^3$ represents an aliphatic group having from 1 to 22 carbon atoms, such as, for example, methyl, ethyl, propyl, butyl, hexyl, octyl, decyl, dodecyl, tridecyl, tetradecyl, hexadecyl, octadecyl, docosanyl, pentenyl, hexenyl, heptenyl, octenyl, decenyl, dodecenyl, tetradecenyl, hexadecenyl, and octadecenyl. These aliphatic groups may have the substituent as shown above for $Y^1$.

More preferably, $a^1$ and $a^2$ each represents a hydrogen atom, an alkyl group having from 1 to 3 carbon atoms (e.g., methyl, ethyl, and propyl), —COO—$Z^4$ or —$Ch_2$COO—$Z^4$ (wherein $Z^4$ represents an alkyl group or an alkenyl group having from 1 to 12 carbon atoms, such as, for example, methyl, ethyl, propyl, butyl, hexyl, octyl, decyl, dodecyl, pentenyl, hexenyl, heptenyl, octenyl, and decenyl and these alkyl group and alkenyl group each may have the substituent as shown above for $Y^1$).

The dispersion stabilizing resin (BA) for use in this invention is a polymer (resin) having at least one recurring unit shown by the aforesaid formula (I) and having no graft group polymerizing with the aforesaid, monomer (A), a part of the main chain of said monomer having been crosslinked and the polymer (resin) being soluble in a non-aqueous solvent for dispersing the aforesaid dispersion resin grains.

The monomer component for the dispersion-stabilizing resin in this invention contains a homopolymer component or copolymer component selected from the recurring units shown by formula (I) described above, or a copolymer component obtained by copolymerizing a monomer corresponding to the recurring unit shown by formula (I) and other monomers capable of copolymerizing with the aforesaid monomer and a part of the polymer main chain has been crosslinked.

As other polymers which are used for copolymerizing with the monomer corresponding to the recurring unit shown by formula (I), any monomers each having a polymerizable double bond can be used and examples thereof are unsaturated carboxylic acids such as acrylic acid, methacrylic acid, crotonic acid, itaconic acid, etc.; ester derivatives or amide derivatives of an unsaturated carboxylic acid having not more than 6 carbon atoms; vinyl esters or allyl esters of a carboxylic acid; styrene, methacrylonitrile; acrylonitrile; and heterocyclic compounds having a polymer double bond. More practically, these monomers include the same compounds as those illustrated later as to the monomer (A) to be insolubilized.

The content of the component of the recurring unit shown by the formula (I) in the polymer component of the dispersion-stabilizing resin in this invention is at least 30% by weight, preferably at least 50% by weight, and more preferably at least 70% by weight based on the total components of the polymer.

For introducing the crosslinking structure into the polymer, a conventionally known method can be utilized. That is, (1) a method of polymerizing a monomer in the presence of a polyfunctional monomer and (2) a method of incorporating a functional group of proceeding crosslinking into the polymer and causing crosslinking by a polymer reaction.

In this case, since the dispersion stabilizing resin in this invention can be produced by a simple production method (e.g., the method does not have such problems that the reaction requires a long period of time, the reaction is not quantitative, or the reaction system is contaminated with impurities by using a reaction accelerator), it is effective to employ a crosslinking reaction by a functional group having a self-crosslinking reactivity, i.e., —$CONHCH_2OZ^5$ (wherein $Z^5$ represents a hydrogen atom or an alkyl group) or a crosslinking reaction by polymerization.

In the polymerization reaction, it is preferred to crosslink the polymer chains by polymerizing a monomer having two or more polymerizable functional groups together with a monomer corresponding to the recurring unit shown by the aforesaid formula (I).

Practical examples of the polymerizable functional group which can be used for the aforesaid

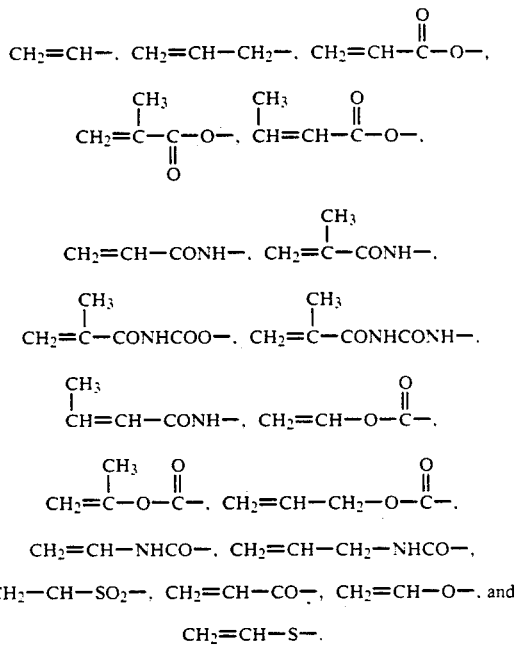

In the monomer having two or more polymerizable functional groups, the functional groups may be the same or different.

Specific examples of the monomer having two or more polymerizable functional groups are as follows.

Examples of the monomer having same polymerizable functional groups are styrene derivatives such as divinylbenzene, trivinylbenzene, etc.; methacrylic acid, acrylic acid, or crotonic acid esters, vinyl ethers, or allyl ethers of polyhydric alcohols (e.g., ethylene glycol, diethylene glycol, triethylene glycol, polyethylene glycols #200, #400, and #600, 1,3-butylene glycol, neopentyl glycol, dipropylene glycol, polypropylene glycol, trimethylolpropane, trimethylolethane, and pentaerythritol); vinyl esters, allyl esters, vinyl amides, or allyl amides of dibasic acids (e.g., malonic acid, succinic acid, glutaric acid, adipic acid, pimelic acid, maleic acid, phthalic acid, and itaconic acid); and condensation products of polyamines (e.g., ethylenediamine, 1,3-propylenediamine, and 1,4-dutylenediamine) and carboxylic acid having a vinyl group (e.g., methacrylic acid, acrylic acid, crotonic acid, and allylacetic acid).

Also, examples of the monomer having different polymerizable functional groups are vinyl-containing ester derivatives or amide derivatives (e.g., vinyl methacrylate, vinyl acrylate, vinyl itaconate, allyl methacrylate, allyl acrylate, allyl itaconate, vinyl methacryloylacetate, vinyl methacryloylpropionate, allyl methacryloylpropionate, methacrylic acid vinyloxycarbonyl methyl ester, acrylic acid vinyloxycarbonylmethyloxycarbonylethylene ester, N-allylacrylamide, N-allylmethacrylamide, N-allylitaconic acid amide, and methacryloylpropionic acid allyl amide) of carboxylic acids having a vinyl group (e.g., methacrylic acid, acrylic acid, methacryloylacetic acid, acroylacetic acid, methacryloylpropionic acid, acryloylpropionic acid, itaconiroylacetic acid, itaconiroylpropionic acid, and reaction products of carboxylic acid anhydrides and alcohols or amines (e.g., allyloxycarbonylpropionic acid, allyloxycarbonylacetic acid, 2-allyloxycarbonyl benzoic acid, and allylaminocarbonylpropionic acid); and condensation products of aminoalcohols (e.g., aminoethanol, 1-aminopropanol, 1-aminobutanol, 1-aminohexanol, and 2-aminobutanol) and carboxylic acids having a vinyl group.

The monomer having two or more polymerizable functional groups for use in this invention is polymerized in an amount of not more than 10% by weight, and preferably not more than 8% by weight based on the total monomers, whereby the resin soluble in the non-aqueous solvent is formed.

The weight average molecular weight of the dispersion stabilizing resin for use in this invention is preferably from $1\times10^4$ to $2\times10^5$, and more preferably from $2.5\times10^4$ to $1\times10^5$. If the weight average molecular weight thereof is less than $1\times10^4$, the mean grain size of the resin grains obtained by the polymerization granulation becomes larger (e.g., larger than 0.5 μm) and also the grain size distribution thereof becomes broader. Also, if the weight average molecular weight is higher than $2\times10^5$, the mean grain size of the resin grains obtained by the polymerization granulation also becomes larger (e.g., larger than 0.5 μm) and the grain size distribution becomes broader. Accordingly, in such cases, it is sometimes difficult to obtain resin grains having a mean grain size in the preferred range of from 0.15 μm to 0.4 μm.

The dispersion-stabilizing resin for use in this invention is preferably produced by a conventional method which comprises polymerizing a monomer corresponding to the recurring unit shown by the aforesaid formula (I) in the presence of at least the aforesaid polymerizable polyfunctional monomer using a polymerization initiator (e.g., azobis series compounds and peroxides).

The amount of the polymerization initiator used is from 0.5 to 15% by weight, and preferably from 1 to 10% by weight per 100 parts by weight of the total monomers.

The dispersion-stabilizing resin used in this invention is thus produced as described above adsorbs on the insoluble resin grains by interacting with the insoluble resin grains. The resin grains having adsorbed thereto the dispersion-stabilizing resin show a greatly improved affinity with the non-aqueous solvent since the dispersion-stabilizing resin which becomes soluble in the non-aqueous solvent has been crosslinked. In addition to that, the affinity of the interface of the insoluble resin particles with the non-aqueous solvent has been improved as described above, it is assumed that the dispersion-stabilizing resin existing in the non-aqueous solvent without adsorbing the resin grains sterically inhibit the resin grains having adsorbed thereto the dispersion-stabilizing resin from aggregating with each other.

Thus, it is considered that the aggregation and precipitation of the insoluble resin grains are inhibited to greatly improve the re-dispersibility of the resin grains.

The monofunctional monomer (A) in this invention may be a monofunctional monomer which is soluble in the non-aqueous solvent but becomes insoluble by being polymerized.

Practical examples of the monomer include the monomers represented by the following formula (II);

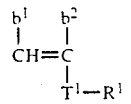

(II)

wherein $T^1$ represents —COO—, —OCO—, —$CH_2$OCO—, —$CH_2$COO—, —O—,

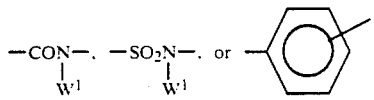

wherein $W^1$ represents a hydrogen atom or an aliphatic group having from 1 to 18 carbon atoms, which may be substituted (e.g., methyl, ethyl, propyl, butyl, 2-chloroethyl, 2-bromoethyl, 2-cyanoethyl, 2-hydroxyethyl, benzyl, chlorobenzyl, methylbenzyl, methoxybenzyl, phenethyl, 3-phenylpropyl, dimethylbenzyl, fluorobenzyl, 2-methoxyethyl, and 3-methoxypropyl).

$R^1$ in the above formula represents an aliphatic group having from 1 to 6 carbon atoms, which may be substituted (e.g., methyl, ethyl, propyl, butyl, 2-bromoethyl, 2-glycidylethyl, 2-hydroxyethyl, 2-hydroxypropyl, 2,3-dihydroxypropyl, 2-hydroxy-3-chloropropyl, 2-cyanoethyl, 3-cyanopropyl, 2-nitroethyl, 2-methoxyethyl, 2-methanesulfonylethyl, 2-ethoxyethyl, N,N-dimethylaminoethyl, N,N-diethylaminoethyl, trimethoxysilylpropyl, 3-bromopropyl, 4-hydroxybutyl, 2-furfurylethyl, 2-thienylethyl, 2-pyridiylethyl, 2-morpholinoethyl, 2-carboxyethyl, 3-carboxypropyl, 4-carboxybutyl, 2-phosphoethyl, 3-sulfopropyl, 4-sulfobutyl, 2-carboxyamidoethyl, 3-sulfoamidopropyl, 2-N-methylcarboxyamidoethyl, cyclopentyl, chlorocyclohexyl, and dichlorohexyl).

Also, in the above formula, $b^1$ and $b^2$, which may be the same or different, each represents the same group as $a^1$ or $a^2$ in formula (I).

Specific examples of the monofunctional monomer (A) are vinyl esters or alkylesters of an aliphatic carboxylic acid having from 1 to 6 carbon atoms (e.g., acetic acid, propionic acid, butyric acid, monochloroacetic acid, and trifluoropropionic acid); alkyl esters or alkyl amides (said alkyl having from 1 to 4 carbon atoms, which may be substituted) of an unsaturated carboxylic acid such as acrylic acid, methacrylic acid, crotonic acid, itaconic acid, maleic acid, etc. (examples of the alkyl group are methyl, ethyl, propyl, butyl, 2-chloroethyl, 2-bromoethyl, 2-fluoroethyl, trifluoroethyl, 2-hydroxyethyl, 2-cyanoethyl, 2-nitroethyl, 2-methoxyethyl, 2-methanesulfonylethyl, 2-benzenesulfonylethyl, 2-(N,N-dimethylamino)ethyl, 2-(N,N-diethylamino)ethyl, 2-carboxyethyl, 2-phosphoethyl, 4-carboxybutyl, 3-sulfopropyl, 4-sulfobutyl, 3-chloropropyl, 2-hydroxy-3-chloropropyl, 2-flufurylethyl, 2-pyridinylethyl, 2-thienylethyl, trimethoxysilylpropyl, and 2-carboxyamidoethyl); styrene derivatives (e.g., styrene, vinyltoluene, α-methylstyrene, vinylnaphthalene, chlorostyrene, dichlorostyrene, bromostyrene, vinylbenzenecarboxylic acid, vinylbenzenesulfonic acid, chloromethylstyrene, hydroxymethylstyrene, methoxymethylstyrene, vinylbenzenecarboxyamide, and vinylbenzenesulfoamide); unsaturated carboxylic acids such as acrylic acid, methacrylic acid, crotonic acid, maleic acid, itaconic acid, etc.; cyclic anhydrides of maleic acid and itaconic acid; acrylonitrile; methacrylonitrile; and heterocyclic compounds having a polymerizable double bond (practically the compounds described in *Koobunshi* (*Macromolecular*) *Data Handbook* (*Foundation*), pages 175–184, edited by Kobunshi Gakkai, published by Baihukan, 1986, such as, for example, N-vinylpyridine, N-vinylimidazole, N-vinylpyrrolidone, vinylthiophene, vinyltetrahydrofuran, vinyloxazoline, vinylthiazole, and N-vinylmorpholine).

The monomers (A) may be used singly or as a combination thereof.

According to a preferred embodiment of this invention, the dispersion resin grains used in this invention are obtained by polymerizing a monomer (B-1) having at least two polar groups and/or polar linkage groups together with the mono-functional monomer (A) which is soluble in the aforesaid non-aqueous solvent but becomes insoluble by being polymerized.

Practical examples of the monomer (B-1) having at least two polar groups and/or polar linkage groups are monomers represented by following formula (II-1)

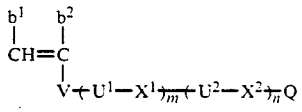

(II-1)

wherein V represents —O—, —COO—, —OCO—, $—CH_2OCO—$, $—SO_2—$, —CONH—, $—SO_2NH—$,

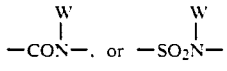

(wherein W represents a hydrocarbon group or has the same meaning as the bonding group, $—U^1—X^1—_mU^2—X^2—_nQ$ in the aforesaid formula (II-1); Q represents a hydrogen atom or a hydrocarbon group having from 1 to 18 carbon atoms, which may be substituted by a halogen atom, —OH, —CN, $—NH_2$, —COOH, $—SO_3H$, or $—PO_3H_2$; $X^1$ and $X^2$, which may be the same or different, each represents —O—, —S—, —CO—, $—CO_2—$, —OCO)—, $—SO_2—$,

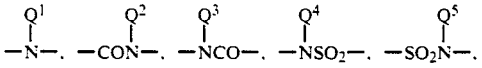

$—NHCO_2—$or —NHCONH— (wherein $Q^1$, $Q^2$, $Q^3$, $Q^4$, and $Q^5$ have the same meaning as Q described above); $U^1$ and $U^2$, which may be the same or different, each represents a hydrocarbon group having from 1 to 18 carbon atoms which may be substituted or may contain

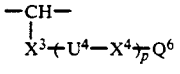

(wherein $X^3$ and $X^4$, which may be the same or different, have the same meaning as $X^1$ and $X^2$ described above; $U^4$ represents a hydrocarbon group having from 1 to 18 carbon atoms, which may be substituted; and $Q^6$ has the same meaning as Q) in the main chain bond; $b^1$ and $b^2$, which may be the same or different, each represents a hydrogen atom, a hydrocarbon group, $—COO—R^1$ or $—COO—R^1$ bonded via a hydrocarbon group (wherein $R^1$ represents a hydrogen atom or a hydrocarbon group which may be substituted); and m, n and p, which may be the same or different, each represents an integer of from 0 to 4.

Then, the monomer (B-1) shown by formula (II-1) for use in this invention is described in more detail.

In formula (II-1), V represents preferably —O—, —COO—, —OCO—, $—CH_2OCO—$, —CONH— or

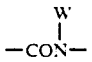

(wherein W represents preferably an alkyl group having from 1 to 16 carbon atoms, which may be substituted, an alkenyl group having from 2 to 16 carbon atoms, which may be substituted, an alicyclic group having from 5 to 18 carbon atoms, which may be substituted, or has the same meaning as the bonding group, $—U^1—X^1—_mU^2—X^2—_nQ$ in formula (II-1).

Q represents preferably a hydrogen atom or an aliphatic group having from 1 to 16 carbon atoms, which may be substituted by a halogen atom (e.g., chlorine and bromine), —OH, —CN, or —COOH (examples of the aliphatic group are an alkyl group, an alkenyl group, and an aralkyl group).

$X^1$ and $X^2$, which may be the same or different, each represents preferably —O—, —S—, —CO—, —COO—, —OCO—,

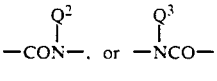

(wherein $Q^2$ and $Q^3$ each has the same meaning as Q described above).

$U^1$ and $U^2$, which may be the same or different, each represents a hydrocarbon group having from 1 to 12 carbon atoms (examples of the hydrocarbon group are an alkylene group, an alkenylene group, an arylene group and a cycloalkylene group) which may be substituted or or may contain

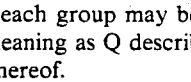

(wherein $X^3$ and $X^4$, which may be the same or different, have the same meaning as $X^1$ and $X^2$ described above; $U^4$ represents preferably an alkylene group having from 1 to 12 carbon atoms, an alkenylene group, or an arylene group, each group may be substituted; and $Q^6$ has the same meaning as Q described above) in the main chain bond thereof.

Also, $b^1$ and $b^2$, which may be the same or different, each represents preferably a hydrogen atom, a methyl group, $—COO—R^1$, or $—CH_2COO—R^1$ (wherein $R^1$ represents preferably a hydrogen atom, an alkyl group having from 1 to 18 carbon atoms, an alkenyl group, an aralkyl group or a cycloalkyl group).

Furthermore, m, n, and p, which may be the same or different, each represents preferably an integer of from 0 to 3.

Furthermore, more preferably, in formula (II-1), V represents —COO—, —CONH, or

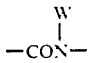

and $b^1$ and $b^2$, which may be the same or different, each represents a hydrogen atom, a methyl group —COO—$R^1$, or —$CH_2COO$—$R^1$ (wherein $R^1$ represents preferably an alkyl group having from 1 to 12 carbon atoms).

Also practical examples of $U^1$ and $U^2$ are composed of an optional combination of atomic groups such as

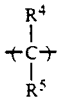

(wherein $R^4$ and $R^5$ each represents a hydrogen atom, an alkyl group, or a halogen atom),

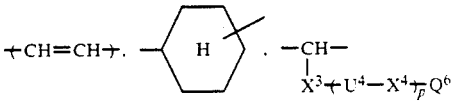

(wherein $X^3$, $U^4$, $X^4$, $Q^6$, and p have the same meaning as described above), etc.

Also, in the bonding group,

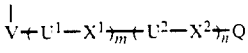

in the formula (II-1), it is preferred that the linkage main chain composed of V, $U^1$, $X^1$, $U^2$, $X^2$, and Q has a total number of atoms at least 8. In this case, when V represents

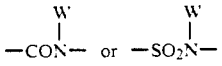

and W represents —$U^1$—$X^1$—$_m$$U^2$—$X^2$—$_n$Q, the linkage main chain composed by W is included in the aforesaid linkage main chain. Furthermore, $X^3$—$U^4$—$X^4$—$_p$$Q^6$, in the case of the hydrocarbon group having

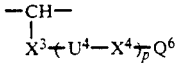

in the main chain bond is also included in the aforesaid linkage main chain.

As to the number of atoms of the linkage main chain, when, for example, V represents —COO— or —CONH— the oxo group (=O) and the hydrogen atom are not included in the number of atoms but the carbon atom(s), ether-type oxygen atom, and nitrogen atom each constituting the linkage main chain are included in the number of atoms. Thus, the number of atoms of —COO— and —CONH— is counted as 2. Also, when, for example, Q represents —$C_9H_{19}$, the hydrogen atoms are not included in the number of atoms and the carbon atoms are included therein. Thus, the number of atoms in this case is counted as 9.

Specific examples of the monomer (II-1) are illustrated below.

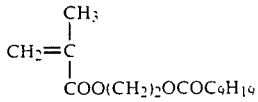

(II-1-1)

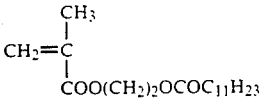

(II-1-2)

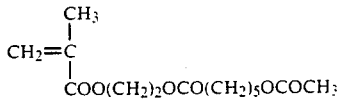

(II-1-3)

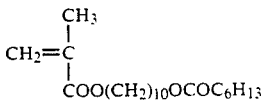

(II-1-4)

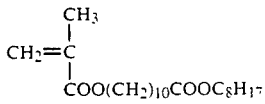

(II-1-5)

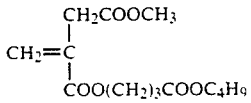

(II-1-6)

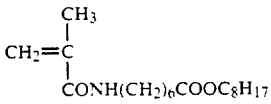

(II-1-7)

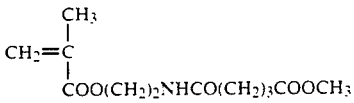

(II-1-8)

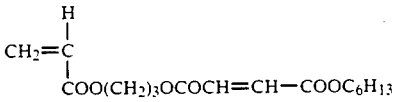

(II-1-9)

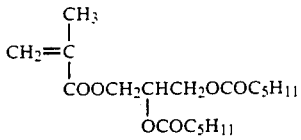

(II-1-10)

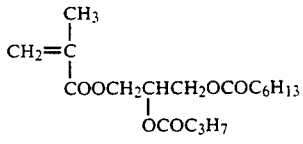

(II-1-11)

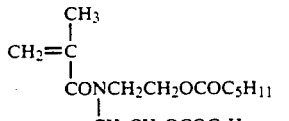

(II-1-12)

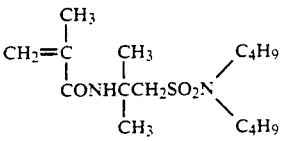

(II-1-13)

-continued (II-1-14)

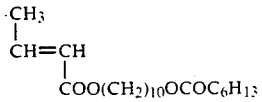

(II-1-15)

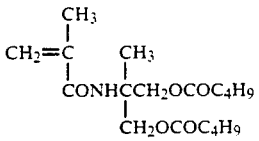

(II-1-16)

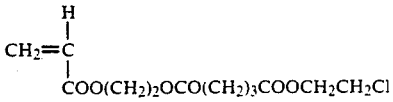

(II-1-17)

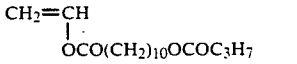

(II-1-18)

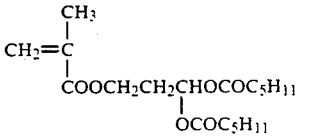

(II-1-19)

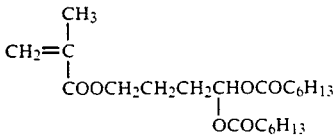

(II-1-20)

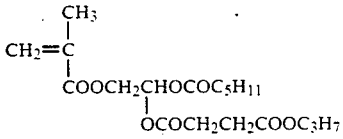

(II-1-21)

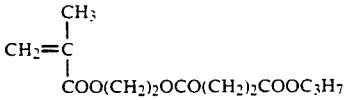

(II-1-22)

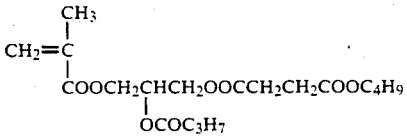

(II-1-23)

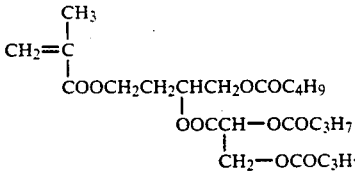

(II-1-24)

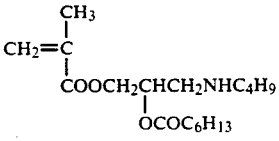

(II-1-25)

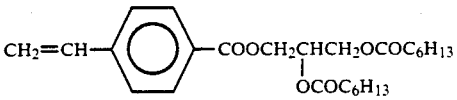

-continued (II-1-26)

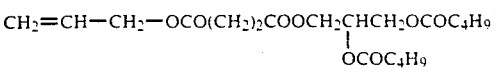

(II-1-27)

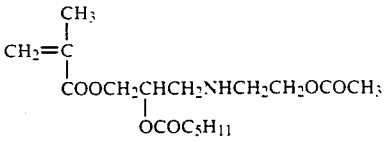

(II-1-28)

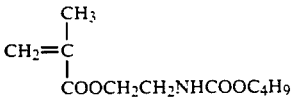

(II-1-29)

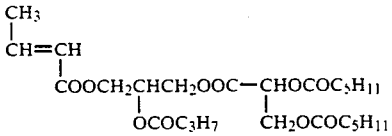

According to the aforesaid embodiment of this invention, the dispersion resin grains are composed of at least one kind of the monomer (A) and at least one kind of the monomer (B-1), and it is important that the desired dispersion resin grains can be obtained if the resin produced from these monomers is insoluble in the non-aqueous solvent. More practically, in the aforesaid case, the proportion of the monomer (B-1) shown by formula (II-1) is preferably from 0.1 to 10% by weight, and more preferably from 0.2 to 8% by weight based on the amount of the monomer (A) being insolubilized. Also, the molecular weight of the dispersion resin grains is from $1\times10^3$ to $1\times10^6$, and more preferably from $1\times10^4$ to $1\times10^6$.

The liquid developer for electrostatic photography in the aforesaid embodiment of this invention has the feature of showing an excellent fixing property while keeping a good re-dispersibility by the use of the monomer (B-1) in combination with the monomer (A).

According to another preferred embodiment of this invention, the dispersion resin grains for use in this invention are produced by copolymerizing a monomer (B-2) having an aliphatic group having 8 or more carbon atoms in combination with the functional monomer (A) which is soluble in the aforesaid non-aqueous solvent but becomes insoluble therein by being polymerized.

Specific examples of the monomer (B-2) containing an aliphatic group having 8 or more carbon atoms include monomers shown by the following formula (II-2):

(II-2)

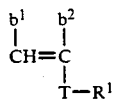

wherein $R^1$ represents an aliphatic group having 8 or more carbon atoms; T represents —COO—, —CONH—,

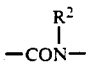

(wherein $R^2$ represents an aliphatic group), —OCO—, —$CH_2COO$—, or —O—; and $b^1$ and $b^2$, which may be the same or different, each represents a hydrogen atom, an alkyl group, —$COOR^3$, or —$CH_2COOR^3$ (wherein $R^3$ represents an aliphatic group).

In formula (II-2), $R^1$ represents preferably an alkyl group having a total number of carbon atoms of 10 or more, which may be substituted, or an alkenyl group having a total number of carbon atoms of 10 or more and T represents preferably —COO—, —CONH—, $$-\overset{\overset{R^2}{|}}{C}ON$$

(wherein $R^2$ represents preferably an aliphatic group having from 1 to 32 carbon atoms (examples of the aliphatic group are an alkyl group, an alkenyl group, or an aralkyl group), —OCO—, —$CH_2OCO$—, or —O—.

Also, $b^1$ and $b^2$, which may be the same or different, each represents preferably a hydrogen atom, a methyl group, —COOR—, or —$CH_2COOR^3$ (wherein $R^3$ represents preferably an alkyl group having from 1 to 32 carbon atoms, an alkenyl group, an aralkyl group, or a cycloalkyl group).

In formula (II-2), it is more preferable that T represents —COO—, —CONH—, or $$-\overset{\overset{R^2}{|}}{C}ON-:$$

$b^1$ and $b^2$, which may be the same or different, each represents a hydrogen atom or a methyl group; and $R^1$ has the same meaning as described above.

Specific examples of the monomer (B-2) shown by formula (II-2) are unsaturated carboxylic acid esters having an aliphatic group of from 10 to 32 total carbon atoms (examples of the carboxylic acid are acrylic acid, methacrylic acid, crotonic acid, maleic acid, and itaconic acid, and examples of the aliphatic group are decyl, dodecyl, tridecyl, tetradecyl, hexadecyl, octedecyl, docosanyl, dodecenyl, hexadecenyl, oleyl, linoleyl, and docosenyl; the above aliphatic group may have a substituent such as a halogen atom, a hydroxy group, an amino group, an alkoxy group, etc., or may have a hetero atom such as oxgen, sulfur, nitrogen, etc., in the carbon-carbon bond of the main chain thereof); unsaturated carboxylic acid amides having an aliphatic group having from 10 to 32 carbon atoms (the unsaturated carboxylic acid and the aliphatic group are same as those described above on the esters); vinyl esters or allyl esters of a higher aliphatic acid (examples of the higher aliphatic acid are lauric acid, myristic acid, stearic acid, oleic acid, linolic acid, and behenic acid); and vinyl ethers substituted by an aliphatic group having from 10 to 32 carbon atoms (the aliphatic group is same as described above).

Then, the monomer (B-2) shown by formula (II-2) for use in this invention is described below in more detail.

According to the aforesaid preferred embodiment of this invention, the dispersion resin grains for use in this invention are composed of at least one kind of the monomer (A) and at least one kind of the monomer (B-2) and it is also important that the desired dispersion resin grains can be obtained if the resin synthesized from these monomers is insoluble in the non-aqueous solvent. More practically, the proportion of the monomer (B-2) shown by formula (II-2) is preferably from 0.1 to 20% by weight, and more preferably from 0.3 to 8% by weight based on the amount of the monomer (A). The molecular weight of the dispersion resin grains is preferably from $1\times10^3$ to $1\times10^6$, and more preferably from $1\times10^4$ to $1\times10^6$.

The liquid developer for electrostatic photography for use in this invention has a feature of showing a very excellent re-dispersibility by the use of the monomer (B-2) in combination with the monomer (A).

The dispersion resin grains (latex grains) for use in this invention can be generally produced by heat-polymerizing the aforesaid dispersion-stabilizing resin, the monomer (A) and the monomer (B-1) or (B-2) in a non-aqueous solvent in the presence of a polymerization initiator such as benzoyl peroxide, azobisisobutyronitrile, butyl-lithium, etc.

Practically, the dispersion resin grains can be produced by (1) a method of adding the polymerization initiator to a solution of a mixture of the dispersion-stabilizing resin, the monomer (A), and the monomer (B-1) or (B-2), (2) a method of adding dropwise the monomer (A) and the monomer (B-1) or (B-2) together with the polymerization initiator to a solution of the dispersion-stabilizing resin, (3) a method of adding the polymerization initiator and a part of a mixture of the monomer (A) and the monomer (B-1) or (B-2) to a solution of the total amount of the dispersion-stabilizing resin and the remaining monomer (A) and monomer (B-1) or (B-2), or (4) a method of adding a solution of the dispersion-stabilizing resin and the monomers (A) and (B-1) or (B-2) together with the polymerization initiator to a non-aqueous solvent.

The total amount of the monomer (A) and the monomer (B-1) or (B-2) is from about 5 to 80 parts by weight, and preferably from 10 to 50 parts by weight per 100 parts by weight of the non-aqueous solvent.

Also, the amount of the dispersion-stabilizing resin (dispersion stabilizer) which is a soluble resin is from 1 to 100 parts by weight, and preferably from 10 to 50 parts by weight per 100 parts by weight of the total monomers (A) and (B-1) or (B-2).

The proper amount of the polymerization initiator is from 0.1 to 5% by weight of the total amount of the monomers (A) and (B-1) or (B-2).

The polymerization temperature is from about 50° C. to 180° C., and preferably from 60° C. to 120° C. The reaction time is preferably from 1 to 15 hours.

When a polar solvent such as alcohols, ketones, ethers, esters, etc., is used together with the non-aqueous solvent for the aforesaid reaction or when unreacted monomer (A) and/or monomer (B-1) or (B-2) remain without being polymerization-granulated, it is preferred to remove the polar solvent or the unreacted monomers by heating the reaction mixture to the boiling point of the solvent or the monomers to distil off them or distil off the solvent or the monomers under reduced pressure.

The latex grains dispersed in a non-aqueous solvent thus produced exist as fine grains having a uniform grain size distribution and show a very stable dispersibility. In particular, when the liquid developer composed of the latex grains are repeatedly used in a developing device for a long period of time, the dispersibility thereof is good and when the development speed is increased, the re-dispersibility is easy and the occurrence of stains by attaching of the grains onto each part of the developing device is not observed.

Also, the latex grains are fixed by heating, etc., a strong coating or layer is formed, which shows an excellent fixing property.

Furthermore, the liquid developer of this invention shows excellent dispersion stability, redispersibility, and fixing property when the liquid developer is used in a quickened development-fix step with a prolonged interval period of the maintenances.

The liquid developer of this invention may contain, if desired, a colorant.

There is no specific restriction on the colorant being used, and any conventional pigments or dyes can be used as the colorant in this invention.

In the case of coloring the dispersion resin itself, there is, for example, a method of coloring the dispersion resin by physically dispersing a pigment or dye in the dispersion resin and various pigments and dyes can be used. For example, there are a magnetic iron oxide powder, a lead iodide powder, carbon black, nigrosine, Alkali Blue, Hansa Yellow, quinacridone red, phthalocyanine blue, etc.

As another method of coloring the dispersion resin grains, the dispersion resin may be dyed with a desired dye, for example, as disclosed in JP-A-57-48738. As still other method, a dye may be chemically bonded to the dispersion resin as disclosed, for example, in JP-A-53-54029 or a previously dye-containing monomer is used in the polymerization granulation to provide a dye-containing dispersion resin as disclosed, for example, in JP-B-44-22955. (The term "JP-B" as used herein means an "examined Japanese patent publication".).

Various additives may be added to the liquid developer for enhancing the charging characteristics or improving the image characteristics and they are practically described in Yuuju Harasaki, *Electrophotography*, Vol. 16, No. 2, page 44.

Specific examples of these additives include metal salts of 2-ethylhexylsulfosuccinic acid, metal salts of naphthenic acid, metal salts of higher fatty acids, lecitin, poly(vinylpyrrolidone), and copolymers containing a semi-maleic acid amide component.

The amounts of the main constituting components of the liquid developer of this invention are further described below.

The amount of the toner grains consisting essentially of the dispersion resin and, if desired, a colorant is preferably from about 0.5 to 50 parts by weight per 1,000 parts by weight of the liquid carrier. If the amount thereof is less than about 0.5 part by weight, the image density formed is sufficient and if the amount is over about 50 parts by weight, non-image portions are liable to be fogged. Furthermore, the above-mentioned liquid carrier-soluble resin for enhancing the dispersion stability may also be used, if, desired, in an amount of from about 0.5 by weight to 100 parts by weight per 1,000 parts by weight of the liquid carrier. Also, the charge-controlling agent as described above is used in an amount of preferably from 0.001 part by weight to 1.0 part by weight per 1,000 parts by weight of the liquid carrier.

Furthermore, if desired, various additives may be added to the liquid developer and the total amount of these additives is restricted by the electric resistance of the liquid developer. That is, if the electric resistance of the liquid developer in a state of removing the toner grains therefrom becomes lower than $10^9$ Ωm, continuous tone images having good image quality are reluctant to obtain and hence it is necessary to control the amounts of additives in the aforesaid range of not lowering the electric resistance than $10^9$ Ωcm.

Then, the following examples are intended to illustrate the embodiments of this invention in detail but not to limit the scope of this invention in any way.

PRODUCTION EXAMPLE 1 OF DISPERSION-STABILIZING RESIN: PRODUCTION OF P-1

A mixture of 100 g of octadecyl methacrylate, 2 g of divinylbenzene, and 200 g of toluene was heated to 85° C. with stirring under nitrogen gas stream and, after adding 3.0 g of 2,2'-azobis-isobutyronitrile (A.I.B.N.) to the reaction mixture, the reaction was carried out for 4 hours. Then, after adding thereto 1.0 g of A.I.B.N., the reaction was carried out for 2 hours and after further adding thereto 0.5 g of A.I.B.N., the reaction was carried out for 2 hours. After cooling, the reaction mixture was re-precipitated in 1.5 liters of methanol and a white powder thus formed was collected by filtration and dried to provide 88 g of the powder of the desired resin. The weight average molecular weight of the polymer (resin) thus obtained was $3.3\times10^4$.

PRODUCTION EXAMPLES 2 TO 14 OF DISPERSION-STABILIZING RESIN: PRODUCTIONS OF P-2 TO P-14

By following the same procedure as Production Example 1 except that each of the monomers shown in Table 1 below was used in place of octadecyl methacrylate, each of dispersion-stabilizing resins was produced.

The weight average molecular weights of the resins obtained were from $3.0\times10^4$ to $5\times10^4$.

TABLE 1

| Production Example | Dispersion-Stabilizing Resin | Monomer | |
|---|---|---|---|
| 2 | P-2 | Dodecyl methacrylate | 100 g |
| 3 | P-3 | Tridecyl methacrylate | 100 g |
| 4 | P-4 | Octyl methacrylate | 20 g |
| | | Dodecyl methacrylate | 80 g |
| 5 | P-5 | Octedecyl methacrylate | 70 g |
| | | Butyl methacrylate | 30 g |
| 6 | P-6 | Dodecyl methacrylate | 95 g |
| | | N,N-Dimethylaminoethyl methacrylate | 5 g |
| 7 | P-7 | Octadecyl methacrylate | 96 g |
| | | 2-(Trimethoxysilyloxy)-ethyl methacrylate | 4 g |
| 8 | P-8 | Hexadecyl methacrylate | 100 g |
| 9 | P-9 | Tetradecyl methacrylate | 100 g |
| 10 | P-10 | Octadecyl methacrylate | 95 g |
| | | Methacrylic acid | 5 g |
| 11 | P-11 | Dodecyl methacrylate | 90 g |
| | | Vinyl acetate | 10 g |
| 12 | P-12 | Octadecyl methacrylate | 92 g |
| | | 2-Hydroxyethyl methacrylate | 8 g |
| 13 | P-13 | Dodecyl methacrylate | 90 g |
| | | Styrene | 10 g |
| 14 | P-14 | Dodecyl methacrylate | 92 g |
| | | N-Vinylpyrrolidone | 8 g |

PRODUCTION EXAMPLES 15 TO 27 OF DISPERSION-STABILIZING RESIN: PRODUCTIONS OF P-15 TO 27

By following the same procedure as Production Example 1 except that each of the polyfunctional monomers or the oligomers shown in Table 2 below was used in place of 2 g of divinylbenzene which was a crosslinking polyfunctional monomer, each of dispersion-stabilizing resins was produced.

The weight average molecular weight of the resins obtained were from $3\times10^4$ to $6\times10^4$.

TABLE 2

| Production Example | Dispersion-Stabilizing Resin | Crosslinking Monomer or Oligomer | |
|---|---|---|---|
| 15 | P-15 | Ethylene Glycol methacrylate | 3.0 g |
| 16 | P-16 | Diethylene glycol dimethacrylate | 5.0 g |
| 17 | P-17 | Vinyl methacrylate | 3.5 g |
| 18 | P-18 | Isopropenyl methacrylate | 4.0 g |
| 19 | P-19 | Vinyl adipate | 3.0 g |
| 20 | P-20 | Diallyl glutaconate | 5.0 g |
| 21 | P-21 | ISP-22 GA (made by Okamura Seiyu K.K.) | 9.6 g |
| 22 | P-22 | Triethylene glycol diacrylate | 2.2 g |
| 23 | P-23 | Trivinylbenzene | 1.2 g |
| 24 | P-24 | Polyethylene glycol #400 diacrylate | 8.0 g |
| 25 | P-25 | Polyethylene glycol dimethacrylate | 9.8 g |
| 26 | P-26 | Trimethylolpropane triacrylate | 4.0 g |
| 27 | P-27 | Polyethylene glycol #600 diacrylate | 12.0 g |

PRODUCTION EXAMPLE 28 OF DISPERSION-STABILIZING RESIN: PRODUCTIONS OF P-8

A mixture of 95 g of octadecyl methacrylate, 5 g of N-methoxymethylacrylamide, 150 g of toluene, and 50 g of isopropanol was heated to 75° C. under nitrogen gas stream and after adding 3.0 g of A.I.B.N. to the reaction mixture, the reaction was carried out for 8 hours. Then, the reaction mixture was heated to 110° C. using Dean-Stark refluxing apparatus followed by stirring for 6 hours. The solvent, isopropanol used in the reaction and methanol by produced were removed.

After cooling, the reaction mixture obtained was reprecipitated from 1.5 liters of methanol and a white powder thus formed was collected by filtration and dried to obtain 82 g of the desired resin. The weight average molecular weight of the resin was $5.6\times10^4$.

PRODUCTION EXAMPLE 1 OF LATEX GRAINS: PRODUCTION OF LATEX GRAIN D-1

A mixture of 20 g of the dispersion-stabilizing resin P-1, 100 g of vinyl acetate, and 384 g of Isopar H was heated to 70° C. with stirring under nitrogen gas stream. Then, after adding thereto 0.8 g of 2,2'-azobis-(isovaleronitrile) (A.I.V.N.) as a polymerization initiator, the reaction was carried out for 3 hours.

20 minutes after the addition of the polymerization initiator, the reaction mixture became white-turbid and the reaction temperature raised to 88° C. After further adding 0.5 g of the polymerization initiator to the reaction mixture followed by carrying out the reaction for 2 hours, the temperature of the reaction mixture was raised to 100° C. and stirred for 2 hours to distil off unreacted vinyl acetate. After cooling, the reaction mixture was passed through a 200 mesh nylon cloth to obtain the desired latex having a mean grain size of 0.25 μm with a polymerization ratio of 90% as a white dispersion.

PRODUCTION EXAMPLES 2 TO 18 OF LATEX GRAINS: PRODUCTIONS OF LATEX GRAINS D-2 TO D-18

By following the same procedure as Production Example 1 of latex grains except that each of the dispersion-stabilizing resins described in Table 3 below was used in place of the dispersion-stabilizing resin P-1, each of the latex grains D-2 to D-18 was produced.

TABLE 3

| Production of Latex Grains | Latex Grains | Dispersion-Stabilizing Resin | Latex Grain Polymerization Ratio (%) | Latex Grain Mean Grain Size (μm) |
|---|---|---|---|---|
| 2 | D-2 | P-2 | 88 | 0.22 |
| 3 | D-3 | P-3 | 89 | 0.23 |
| 4 | D-4 | P-5 | 87 | 0.22 |
| 5 | D-5 | P-7 | 90 | 0.25 |
| 6 | D-6 | P-9 | 89 | 0.22 |
| 7 | D-7 | P-10 | 88 | 0.20 |
| 8 | D-8 | P-12 | 89 | 0.20 |
| 9 | D-9 | P-14 | 88 | 0.25 |
| 10 | D-10 | P-15 | 86 | 0.26 |
| 11 | D-11 | P-19 | 90 | 0.25 |
| 12 | D-12 | P-22 | 88 | 0.26 |
| 13 | D-13 | P-23 | 89 | 0.26 |
| 14 | D-14 | P-24 | 87 | 0.24 |
| 15 | D-15 | P-25 | 86 | 0.26 |
| 16 | D-16 | P-26 | 87 | 0.27 |
| 17 | D-17 | P-27 | 88 | 0.24 |
| 18 | D-18 | P-28 | 85 | 0.22 |

PRODUCTION EXAMPLE 19 OF LATEX GRAINS: PRODUCTION OF LATEX GRAIN D-19

A mixture of 15 g of the dispersion-stabilizing resin P-1, 5 g of poly(octadecyl methacrylate), 100 g of vinyl acetate, and 400 g of Isopar H was heated to 75° C. with stirring under nitrogen gas stream. Then, after adding 0.7 g of A.I.B.N. to the reaction mixture, the reaction was carried out for 4 hours and, after further adding thereto 0.5 g of A.I.B.N., the reaction was carried out for 2 hours. After cooling, the reaction mixture obtained was passed through a 200 mesh nylon cloth to obtain the desired latex grains having a mean grain size of 0.24 μm with a polymerization ratio of 83% as a white dispersion.

PRODUCTION EXAMPLE 20 OF LATEX GRAINS: PRODUCTION OF LATEX GRAIN D-20

A mixture of 20 g of the dispersion-stabilizing resin P-26 and 200 g of Isopar G was heated to 70° C. with stirring under nitrogen gas stream.

Then, a mixture of 100 g of vinyl acetate, 180 g of Isopar G, and 1.0 g of A.I.V.N. was added dropwise to the reaction mixture over a period of 2 hours, and the resulting mixture was stirred for 4 hours as it was. After cooling, the reaction mixture obtained was passed through a 200 mesh nylon cloth to obtain the desired latex grains having a mean grain size of 0.22 μm with a polymerization ratio of 85% as a white dispersion.

PRODUCTION EXAMPLE 21 OF LATEX GRAINS: PRODUCTION OF LATEX GRAIN D-21

A mixture of 20 g of the dispersion-stabilizing resin P-14, 90 g of vinyl acetate, 10 g of N-vinylpyrrolidone, and 400 g of isododecane was heated to 65° C. with stirring under nitrogen gas stream and, after adding 1.5 g of A.I.B.N. to the reaction mixture, the reaction was carried out for 4 hours. After cooling, the reaction mixture was passed through a 200 mesh nylon cloth to obtain latex grains having a mean grain size of 0.25 μm with a polymerization ratio of 85% as a white dispersion.

PRODUCTION EXAMPLE 22 OF LATEX GRAINS: PRODUCTION OF LATEX GRAIN D-22

A mixture of 20 g of the dispersion-stabilizing resin P-10, 94 g of vinyl acetate, 6 g of crotonic acid, and 400 g of Isopar was heated to 60° C. with stirring under nitrogen gas stream. Then, after adding 1.0 g of A.I.V.N. to the reaction mixture, the reaction was carried out for 2 hours and, after further adding thereto 0.5 g of A.I.V.N., the reaction was carried out for 2 hours. After cooling, the reaction mixture was passed through a 200 mesh nylon cloth to obtain latex grains having a mean grain size of about 0.24 μm with a polymerization ratio of 86% as a white dispersion.

PRODUCTION EXAMPLE 23 OF LATEX GRAINS: PRODUCTION OF LATEX GRAIN D-23

A mixture of 25 g of the dispersion-stabilizing resin P-12, 100 g of methyl methacrylate, and 500 g of Isopar H was heated to 60° C. with stirring under nitrogen gas stream and, after adding 0.7 g of A.I.V.N. to the reaction mixture, the reaction was carried out for 4 hours. After cooling, the reaction mixture was passed through a 200 mesh nylon cloth to obtain the desired latex grains having a mean grain size of about 0.36 μm with a polymerization ratio of 88% as a white dispersion.

PRODUCTION EXAMPLE 24 OF LATEX GRAINS: PRODUCTION OF LATEX GRAIN D-24

A mixture of 25 g of the dispersion-stabilizing resin P-13, 100 g of styrene, and 380 g of Isopar H was heated to 45° C. with stirring under nitrogen gas stream and, after adding a hexane solution of n-butyl-lithium in an amount of 1.0 g as the solid n-butyl-lithium, the reaction was carried out for 4 hours. After cooling, the reaction mixture was passed through a 200 mesh nylon cloth to obtain latex grains having a mean grain size of about 0.30 μm with a polymerization ratio of 82% as a white dispersion.

PRODUCTION EXAMPLE 25 OF LATEX GRAINS: COMPARISON EXAMPLE A

By following the same procedure as Production Example 1 of latex grains except that a mixture of 20 g of poly(octadecyl methacrylate), 100 g of vinyl acetate and 380 g of Isopar H was used in place of the mixture used in Example 1, latex grains having a mean grain size of 0.23 μm were obtained with a polymerization ratio of 88% as a white dispersion.

PRODUCTION EXAMPLE 26 OF LATEX GRAINS: COMPARISON EXAMPLE B

A mixture of 98 g of octadecyl methacrylate, 2 g of acrylic acid, 200 g of toluene was heated to 75° C. with stirring under nitrogen gas stream and after adding 1.0 g of 2,2'-azobis(isobutyronitrile) to the reaction mixture, the reaction was carried out for 8 hours.

Then, after adding 6 g of glycidyl methacrylate, 1.0 g of t-butylhydroquinone, and 1.2 g of N,N-dimethyldodecylamine to the reaction mixture, the resulting mixture was stirred for 20 hours at 110° C. After cooling, the reaction mixture was reprecipitated from 2 liters of methanol to form a white powder, which was collected by filtration and dried to obtain a dispersion-stabilizing resin (R-2) shown below. The amount of the product was 84 g, and the weight average molecular weight was $6.5\times10^4$.

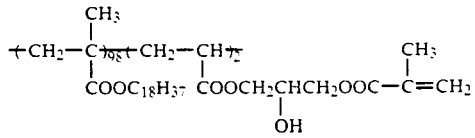

(weight component ratio)

Then, by following the same procedure as Production Example 1 of latex grains except that a mixture of 8 g of the aforesaid dispersion-stabilizing resin (R-2), 100 g of vinyl acetate, and 390 g of Isopar H was used in place of the mixture used in Example 1, latex grains having a mean grain size of 0.12 μm were obtained with a polymerization ratio of 89% as a white dispersion.

PRODUCTION EXAMPLE 27 OF LATEX GRAINS: COMPARISON EXAMPLE C

By following the same procedure as Production Example 1 of latex grains except that a mixture of 12 g of a dispersion-stabilizing resin having the structure shown below prepared by the method disclosed in JP-A-61-43757, 100 g of vinyl acetate, and 388 g of Isopar H was used in place of the mixture used in Example 1, latex grains having a mean grain size of 0.18 μm were obtained with the polymerization ratio of 88% as a white dispersion.

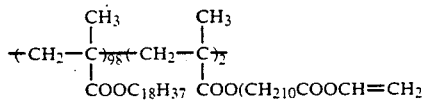

Weight average molecular weight: 43,000

PRODUCTION EXAMPLE 28 OF LATEX GRAINS: PRODUCTION OF LATEX GRAIN D-28

A mixture of 20 g of the dispersion-stabilizing resin P-1, 100 g of vinyl acetate, 1.5 g of the compound II-1-19 as the monomer (B-1), and 384 g of Isopar H was heated to 70° C. with stirring under nitrogen gas stream and, after adding 0.8 g of 2,2'-azobis(isovaleronitrile) as a polymerization initiator to the reaction mixture, the reaction was carried out for 6 hours. Twenty minutes after the addition of the polymerization initiator, the reaction mixture became white turbid, and the reaction temperature raised to 88° C. Then, after raising the temperature to 100° C., the reaction mixture was stirred for 2 hours to distil off unreacted vinyl acetate. After cooling, the reaction mixture was passed through a 200 mesh nylon cloth to obtain latex grains having a mean grain size of 0.20 μm were obtained with a polymerization ratio of 86% as a white dispersion.

PRODUCTION EXAMPLES 29 TO 49 OF LATEX GRAINS: PRODUCTIONS OF LATEX GRAINS D-29 TO D-49

By following the same procedure as Production Example 28 of latex grains except that each of the dispersion-stabilizing resins and each of the monomers (B-1) described in Table 4 below were used in place of the dispersion-stabilizing resin P-1 and the compound II-1-19 as the monomer (B-1), each of latex grains were produced.

The polymerization ratios of the latex grains obtained were from 85% to 90%.

TABLE 4

| Production Example of Latex Grains | Latex Grains | Dispersion-Stabilizing Resin | Monomer (II-1) | Mean Grain Size of Latex (μm) |
|---|---|---|---|---|
| 29 | D-29 | P-1 | II-1-1 | 0.19 |
| 30 | D-30 | P-1 | II-1-2 | 0.19 |
| 31 | D-31 | P-1 | II-1-3 | 0.20 |
| 32 | D-32 | P-1 | II-1-8 | 0.22 |
| 33 | D-33 | P-1 | II-1-9 | 0.22 |
| 34 | D-34 | P-1 | II-1-10 | 0.20 |
| 35 | D-35 | P-1 | II-1-11 | 0.18 |
| 36 | D-36 | P-1 | II-1-14 | 0.17 |
| 37 | D-37 | P-1 | II-1-18 | 0.21 |
| 38 | D-38 | P-2 | II-1-10 | 0.19 |
| 39 | D-39 | P-3 | II-1-19 | 0.20 |
| 40 | D-40 | P-4 | II-1-20 | 0.22 |
| 41 | D-41 | P-5 | II-1-21 | 0.22 |
| 42 | D-42 | P-10 | II-1-22 | 0.23 |
| 43 | D-43 | P-12 | II-1-23 | 0.23 |
| 44 | D-44 | P-15 | II-1-24 | 0.22 |
| 45 | D-45 | P-16 | II-1-15 | 0.23 |
| 46 | D-46 | P-17 | II-1-16 | 0.18 |
| 47 | D-47 | P-23 | II-1-26 | 0.19 |
| 48 | D-48 | P-24 | II-1-27 | 0.20 |
| 49 | D-49 | P-26 | II-1-29 | 0.21 |

PRODUCTION EXAMPLE 50 OF LATEX GRAINS: PRODUCTION OF LATEX GRAINS D-50

A mixture of 8 g (as solid component) of the dispersion-stabilizing resin P-25, 7 g of poly(dodecyl methacrylate), 100 g of vinyl acetate, 1.5 g of Compound II-1-15 as the monomer (B-1), and 380 g of n-decane was heated to 75° C. with stirring under nitrogen gas stream. Then, after adding 1.0 g of 2,2'-azobis(isobutyronitrile)-(A.I.B.N.) to the reaction mixture, the reaction was carried out for 4 hours and, after further adding thereto 0.5 g of A.I.B.N., the reaction was carried out for 2 hours. The temperature of the system was raised to 110° C., and the reaction mixture was stirred for 2 hours to distil off the low-boiling solvent and remaining vinyl acetate. After cooling, the reaction mixture was passed through a 200 mesh nylon cloth to obtain the desired latex grains having a mean grain size of 0.20 μm as a white dispersion.

PRODUCTION EXAMPLE 51 OF LATEX GRAINS: PRODUCTION OF LATEX GRAINS D-51

A mixture of 14 g of the dispersion-stabilizing resin P-14, 85 g of vinyl acetate, 2.0 g of Compound II-1-23 as the monomer (B-1), 15 g of N-vinylpyrrolidone, and 400 g of isododecane was heated to 65° C. with stirring under nitrogen gas stream and, after adding 1.5 g of A.I.B.N. to the reaction mixture, the reaction was carried out for 4 hours. After cooling, the reaction mixture was passed through a 200 mesh nylon cloth to obtain the desired latex grains having a mean grain size of 0.26 μm as a white dispersion.

PRODUCTION EXAMPLE 52 OF LATEX GRAINS: PRODUCTION OF LATEX GRAINS D-52

A mixture of 12 g of the dispersion-stabilizing resin P-10, 100 g of vinyl acetate, 1.5 g of Compound II-1-18 as the monomer (B-1), 5 g of 4-pentenoic acid, and 383 g of Isopar G was heated to 60° C. with stirring under nitrogen gas stream. Then, after adding 1.0 g of 2,2'-azobis(isovaleronitrile) (A.I.V.N.) to the reaction mixture, the reaction was carried out for 2 hours and, after further adding thereto 0.5 g of A.I.V.N., the reaction was carried out for 2 hours. After cooling, the reaction mixture was passed through a 200 mesh nylon cloth to obtain the desired latex grains having a mean grain size of 0.25 μm as a white dispersion.

PRODUCTION EXAMPLE 53 OF LATEX GRAINS: PRODUCTION OF LATEX GRAINS D-53

A mixture of 20 g of the dispersion-stabilizing resin P-7, 2 g of Compound II-1-16 as the monomer (B-1), 1 g of n-dodecylmercatane, and 478 g of Isopar H was heated to 65° C. with stirring under nitrogen gas stream and, after adding 1.2 g of A.I.V.N. to the reaction mixture, the reaction was carried out for 4 hours. After cooling, the reaction mixture was passed through a 200 mesh nylon cloth to remove coarse grains and to obtain the desired latex grains having a mean grain size of 0.28 μm as a white dispersion.

PRODUCTION EXAMPLE 54 OF LATEX GRAINS: PRODUCTION OF LATEX GRAINS D-54

A mixture of 18 g of the dispersion-stabilizing resin P-13, 100 g of styrene, 4 g of Compound II-1-25 as the monomer (B-1), and 380 g of Isopar H was heated to 50° C. with stirring under nitrogen gas stream and, after adding 1.0 g (as solid component) of a hexane solution of n-butyl lithium to the reaction mixture, the reaction was carried out for 4 hours. After cooling, the reaction mixture was passed through a 200 mesh nylon cloth to obtain desired latex grains having a mean grain size of 0.30 μm as a white dispersion.

PRODUCTION EXAMPLE 55 OF LATEX GRAINS: COMPARISON EXAMPLE E

By following the same procedure as Production Example 28 of latex grains except that a mixture of 20 g of poly(octedecyl methacrylate) (weight average molecular weight: 35,000), 100 g of vinyl acetate, 1.5 g of Compound II-1-19 as the monomer (B-1), and 380 g Isopar H was used in place of the mixture used in Example 28, latex grains having a mean grain size of 0.23 μm were obtained with a polymerization ratio of 88% as a white dispersion.

PRODUCTION EXAMPLE 56 OF LATEX GRAINS: COMPARISON EXAMPLE P

By following the same procedure as Production Example 28 of latex grains except that a mixture of 14 g of a dispersion-stabilizing resin having the structure shown below, 100 g of vinyl acetate, 1.5 g of Compound II-1-19 as the monomer (B-1), and 386 g of Isopar H was used in place of the mixture used in Example 28, latex grains having a mean grain size of 0.25 μm were obtained with a polymerization ratio of 90% as a white dispersion.

Dispersion-Stabilizing Resin:

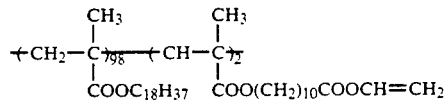

(weight component ratio)

-continued

Weight Average Molecular Weight: 43,000

PRODUCTION EXAMPLE 57 OF LATEX GRAINS: PRODUCTION OF LATEX GRAINS D-57

A mixture of 12 g of the dispersion-stabilizing resin P-1, 100 g of vinyl acetate, 1.0 g of octadecyl methacrylate, and 384 g of Isopar H was heated to 70° C. with stirring under nitrogen gas stream and, after adding 0.8 g of A.I.V.N. to the reaction mixture, the reaction was carried out for 6 hours. Twenty minutes after the addition of the polymerization initiator, the reaction mixture became white-turbid, and the reaction temperature raised to 88° C. Then, after raising the temperature to 100° C., the reaction mixture was stirred for 2 hours to distil off unreacted vinyl acetate. After cooling, the reaction mixture was passed through a 200 mesh nylon cloth to obtain the desired latex grains having a mean grain size of 0.24 μm with a polymerization ratio of 90% as a white dispersion.

PRODUCTION EXAMPLE 58 TO 68 OF LATEX GRAINS: PRODUCTION OF LATEX GRAINS D-58 TO D-68

By following the same procedure as Production Example 1 except that each of the dispersion-stabilizing resins described in Table 5 below was used in place of the dispersion-stabilizing resin P-1, each of the Latex Grains D-58 to D-68 of this invention were obtained.

TABLE 5

| Production Example of Latex Grains | Latex Grains | Dispersion-Stabilizing Resin | Latex: Polymerization Ratio (%) | Latex: Mean Grain Size (μm) |
|---|---|---|---|---|
| 58 | D-58 | P-2 | 88 | 0.25 |
| 59 | D-59 | P-3 | 89 | 0.24 |
| 60 | D-60 | P-4 | 87 | 0.26 |
| 61 | D-61 | P-5 | 90 | 0.24 |
| 62 | D-62 | P-6 | 85 | 0.23 |
| 63 | D-63 | P-7 | 86 | 0.25 |
| 64 | D-64 | P-8 | 85 | 0.23 |
| 65 | D-65 | P-9 | 88 | 0.24 |
| 66 | D-66 | P-12 | 83 | 0.22 |
| 67 | D-67 | P-15 | 86 | 0.28 |
| 68 | D-68 | P-24 | 86 | 0.22 |

PRODUCTION EXAMPLE 69 TO 74 OF LATEX GRAINS: PRODUCTION OF LATEX GRAINS D-69 TO D-74

By following the same procedure as Production Example 57 of latex grains except that 1 g of each of the monomers shown in Table 6 was used in place of 1 g of octadecyl methacrylate in the example, each of latex grains was produced.

TABLE 6

| Production Example of Latex Grains | Latex Grains | Monomer | Latex Grains: Polymerization Ratio (%) | Latex Grains: Mean Grain Size (μm) |
|---|---|---|---|---|
| 67 | D-69 | Docosanyl Methacrylate | 97 | 0.23 |
| 70 | D-70 | Hexadecyl Methacrylate | 97 | 0.24 |
| 71 | D-71 | Tetradecyl Methacrylate | 88 | 0.24 |
| 72 | D-72 | Tridecyl Methacrylate | 86 | 0.24 |
| 73 | D-73 | Dodecyl Methacrylate | 86 | 0.23 |
| 74 | D-74 | Decyl Methacrylate | 87 | 0.26 |

A mixture of 6 g of the dispersion-stabilizing resin P-10, 8 g of poly(octadecyl methacrylate), 100 g of vinyl acetate, 0.8 g of dodecyl methacrylate, and 400 g of Isopar H was heated to 75° C. with stirring under nitrogen gas stream. Then, after adding 0.7 g of 2,2'-azobis(isobutyronitrile)(A.I.B.N.) to the reaction mixture, the reaction was carried out for 4 hours and, after further adding thereto 0.5 g of A.I.B.N., the reaction was carried out for 2 hours. After cooling, the reaction mixture was passed through a 200 mesh nylon cloth to obtain the desired latex grains having a mean grain size of 0.20 μm as a white dispersion.

PRODUCTION EXAMPLE 76 OF LATEX GRAINS: PRODUCTION OF LATEX GRAINS D-76

A mixture of 10 g of the dispersion-stabilizing resin P-14, 90 g of vinyl acetate, 10 g of N-vinylpyrrolidone, 1.5 g of octadecyl methacrylate, and 400 g of isododecane was heated to 65° C. with stirring under nitrogen gas stream and, after adding 1.5 g of A.I.B.N. to the reaction mixture, the reaction was carried out for 4 hours. After cooling, the reaction mixture was passed through a 200 mesh nylon cloth to obtain the desired latex grains having a mean grain size of 0.24 μm as a white dispersion.

PRODUCTION EXAMPLE 77 OF LATEX GRAINS: PRODUCTION OF LATEX GRAINS D-77

A mixture of 20 g of the dispersion-stabilizing resin P-10, 94 g of vinyl acetate, 6 g of crotonic acid, g of hexadecyl methacrylate, and 378 g of Isopar G was heated to 60° C. with stirring under nitrogen gas stream. After adding 1.0 g of A.I.V.N. to the reaction mixture, the reaction was carried out for 2 hours and, after further adding thereto 0.5 g of A.I.V.N., the reaction was carried out for 2 hours. After cooling, the reaction mixture was passed through a 200 mesh nylon cloth to obtain the desired latex grains having a mean grain size of 0.24 μm as a white dispersion.

PRODUCTION EXAMPLE 78 OF LATEX GRAINS: PRODUCTION OF LATEX GRAINS D-78

A mixture of 25 g of the dispersion-stabilizing resin P-16, 100 g of methyl methacrylate, 2 g of decyl methacrylate, 0.8 g of n-dodecylmercaptane, and 540 g of Isopar H was heated to 60° C. with stirring under nitrogen gas stream and, after adding 0.7 g of A.I.V.N. to the reaction mixture, the reaction was carried out for 4 hours. After cooling, the reaction mixture was passed through a 200 mesh nylon cloth to obtain the desired latex grains having a mean grain size of 0.25 μm as a white dispersion.

PRODUCTION EXAMPLE 79 OF LATEX GRAINS: PRODUCTION OF LATEX GRAINS D-79

A mixture of 25 g of the dispersion-stabilizing resin P-13, 100 g of styrene, 2 g of octadecyl vinyl ether, and 380 g of Isopar H was heated to 45° C. with stirring under nitrogen gas stream and, after adding 1.0 g (as solid component) of a hexane solution of n-butyl lithium to the reaction mixture, the reaction was carried out for 4 hours. After cooling, the reaction mixture was passed through a 200 mesh nylon cloth to obtain the desired latex grains having a mean grain size of 0.27 μm as a white dispersion.

PRODUCTION EXAMPLE 80 OF LATEX GRAINS: COMPARISON EXAMPLE G

By following the same procedure as Production Example 57 of latex grains except that a mixture of 20 g of poly(octadecyl methacrylate) (Dispersion-Stabilizing Resin R'-1, 100 g of vinyl acetate, 1 g of octadecyl methacrylate, and 380 g of Isopar H was used in place of the mixture used in Example 57, latex grains having a mean grain size of 0.27 μm were obtained with a polymerization ratio of 88% as a white dispersion.

PRODUCTION EXAMPLE 81 OF LATEX GRAINS: COMPARISON EXAMPLE 81

A mixture of 97 g of octadecyl methacrylate, 3 g of acrylic acid, and 200 g of toluene was heated to 75° C. under nitrogen gas stream and, after adding 1.0 g of A.I.B.N. to the reaction mixture, the reaction was carried out for 8 hours. Then after adding thereto 12 g of glycidyl methacrylate, 1.0 g of t-butylhydroquinone, and 1.2 g of N,N-dimethyldodecylamine, the resulting mixture was stirred for 40 hours at 100° C. After cooling, the reaction mixture was reprecipitated from 2 liters of methanol and a white powder thus formed was collected by filtration and dried to obtain 84 g of dispersion-stabilizing resin R'-2 having the following structure. The weight average molecular weight thereof was 35,000.

Dispersion-Stabilizing Resin R'-2

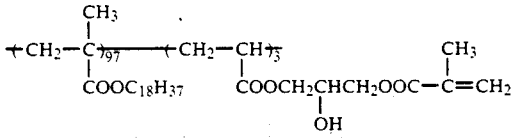

(weight component ratio)

Then, a mixture of 10 g of the dispersion-stabilizing resin R'-2, 100 g of vinyl acetate, 1.0 g of octadecyl methacrylate, and 384 g of Isopar H was used in the same procedure as Production Example 57 of latex grains in place of the mixture used in Example 57, and latex grains having a mean grain size of 0.15 μm were obtained with a polymerization ratio of 89% as a white dispersion.

PRODUCTION EXAMPLE 82 OF LATEX GRAINS: COMPARISON EXAMPLE 1

By following the same procedure as Production Example 57 of latex grains except that a mixture of 12 g of a dispersion-stabilizing resin R'-3 having the structure shown below produced by the method described in JP-A-61-63855, 100 g of vinyl acetate, 1.0 g of octadecyl methacrylate, and 382 g of Isopar H was used in place of the mixture used in Example 57, latex grains having a mean grain size of 0.23 μm were obtained with a polymerization ratio of 87% as a white dispersion.

Dispersion-Stabilizing Resin R'-3:

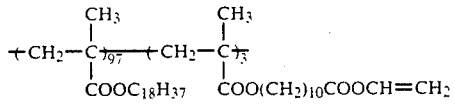

(weight component ratio)

Weight Average Molecular Weight: 46,000

EXAMPLE 1

In a paint shaker (manufactured by Tokyo Seiki K. K.) were placed 10 g of a dodecyl methacrylate/acrylic acid copolymer (95/5 by weight ratio), 10 g of nigrosine, and 30 g of Isopar G together with glass beads and they were dispersed for 4 hours to obtain a fine dispersion of nigrosine.

Then, by diluting 30 g of the latex grains D-1 obtained in Production Example 1 of latex grains, 2.5 g of the aforesaid nigrosine dispersion, 0.07 g of an octadecene-octadecylamide semi-maleate copolymer, and 15 g of a higher alcohol, FOC-1600 (trade name, made by Nissan Chemical Industries, Ltd.) with one liter of Isopar G, a liquid developer for electrostatic photography was prepared.

Comparison Liquid Developers A, B, and C

Three kinds of comparison liquid developers A, B, and C were prepared by the same manner as above except that the resin dispersions (latex grains) shown below each was used in place of the latex grains D-1 used above.

Comparison Liquid Developer A:

The latex grains obtained in Production Example 25 of latex grains were used.

Comparison Liquid Developer B:

The latex grains obtained in Production Example 26 of latex grains were used.

Comparison Liquid Developer C:

The latex grains obtained in Production Example 27 of latex grains were used.

An electrophotographic light-sensitive material, ELP Master II Type (trade name, made by Fuji Photo Film Co., Ltd.) was image-exposed and developed by a full-automatic processor, ELP 404V (trade name, made by Fuji Photo Film Co., Ltd.) using each of the liquid developers thus prepared. The processing (plate-making) speed was 7 plates/minute. Furthermore, after processing 3,000 plates of ELP master II Type, the occurrence of stains of the developing apparatus by sticking of the toner was observed. The blackened ratio (imaged area) of the duplicated images was determined using 30% original. The results obtained are shown in Table 7 below.

TABLE 7

| Test No. | Liquid Developer | Stains of Developing Apparatus | Image of the 3,000th Plate |
|---|---|---|---|
| 1 | Developer of Example 1 | No toner residue adhered. | Clear |
| 2 | Comparison Developer A | Toner residue greatly adhered. | Letter part lost, density of solid black lowered, |

TABLE 7-continued

| Test No. | Liquid Developer | Stains of Developing Apparatus | Image of the 3,000th Plate |
|---|---|---|---|
| | | | background portion fogged. |
| 3 | Comparison Developer B | Toner residue adhered slightly. | Density of solid black of images lowered, solid black portion partially blurred. |
| 4 | Comparison Developer C | Toner residue adhered slightly. | Clear |

Test No. 1: Examples of this invention
Test Nos. 2 to 4: Comparison Examples

As is clear from the results shown in Table 7, when printing plates were produced by the aforesaid processing condition using each liquid developer, the liquid developer only of this invention caused no staining of the developing apparatus and gave clear images of the 3,000th plate.

Then, the offset printing master plate (ELP Master) prepared using each of the liquid developers was used for printing in a conventional manner, and the number of prints obtained before the occurrences of defects of letters on the images of the prints, the blur of solid black portions, etc., was checked. The results showed that the master plate obtained by using each of the liquid developer of this invention and the comparison liquid developers A, B, and C gave more than 10,000 prints without accompanied by the aforesaid failures.

As is clear from the aforesaid results, only the liquid developer of this invention could advantageously be used for preparing a large number of prints by the master plate without causing stains on the developing apparatus by sticking of the toner.

That is, there was no problem on the number of prints in the case of using the comparison liquid developers A, B, and C but in these cases, the developing apparatus was too stained to further use continuously.

In the cases of using the comparison liquid developers B and C, staining of the developing apparatus was greatly reduced as compared to the case of using the comparison liquid developer A but when the development condition became severe, a satisfactory result was not yet obtained. That is, it is considered that the known dispersion-stabilizing resin (R-2) in the comparison liquid developer is a random copolymer wherein the polymerizable double bond which is copolymerized with the monomer (A) (vinylacetate in the comparison example) contained in the polymer exists near the polymer main chain in the component containing the polymerizable double bond group, whereby the resin (R-2) is inferior in the re-dispersibility of the latex grains to the dispersion-stabilizing resin for use in this invention.

Also, the known dispersion-stabilizing resin in the comparison liquid developer C has a chemical structure that the sum of the atoms of the linkage group of linking the polymerizable double bond in the resin, which is copolymerized with the monomer (A), to the polymer main chain moiety of the resin is at least 9 and furthermore, as compared to that the structure of the polymerizable double bond group in the comparison liquid developer B is $$CH_2{=}\overset{\overset{\displaystyle CH_3}{|}}{C}{-}COO{-}.$$

the structure of the polymerizable double bond group in the comparison liquid developer C is $CH_2{=}CH{-}OCO{-}$, which is preferred since such a structure has a good reactivity with vinyl acetate (monomer (A)). Thus, in the case of using the comparison liquid developer C, the images of the 3,000th printing plate formed are clear and, thus, are greatly improved as compared to the case of using the comparison liquid developer B. However, even in the case of using the comparison liquid developer C, staining of the developing apparatus by sticking of the toner is yet unsatisfactory when the development condition becomes severe.

EXAMPLE 2

A mixture of the white resin dispersion obtained in Production Example 1 of latex grains and 1.5 g of Sumikalon black was heated to 100° C. and stirred for 4 hours at the temperature. After cooling to room temperature, the reaction mixture was passed through a 200 mesh nylon cloth to remove the remaining dye, whereby a black resin dispersion having a mean grain size of 0.25 μm was obtained.

By diluting 30 g of the aforesaid black resin dispersion, 0.05 g of zirconium naphthenate, and 20 g of a higher alcohol, FOC-1600 (trade name, made by Nissan Chemical Industries, Ltd.) with one liter of Shellsol 71, a liquid developer was prepared.

When the liquid developer was applied to the same developing apparatus as in Example 1 for making printing plates, no occurrence of stains of the developing apparatus by sticking of the toner was observed even after developing 3,000 plates.

Also, the quantity of the offset printing master plate obtained was clear and also the image quality of the 10,000 prints formed using the master plate was very clear.

EXAMPLE 3

A mixture of 100 g of the white dispersion obtained in Production Example 22 of latex grains and 3 g of Victoria Blue B was heated to a temperature of from 70° C. to 80° C. with stirring for 6 hours. After cooling to room temperature, the reaction mixture was passed through a 200 mesh nylon cloth to remove the remaining dye, thereby a blue resin dispersion having a mean grain size of 0.25 μm was obtained.

By diluting 32 g of the aforesaid blue resin dispersion, 0.05 g of zirconium naphthenate, and 15 g of a higher alcohol, FOC-1400 (trade name, made by Nissan Chemical Industries, Ltd.) with one liter of Isopar H, a liquid developer was prepared.

When the liquid developer was applied to the same developing apparatus as in Example 1 for making printing plates, no occurrence of stains of the developing apparatus by sticking of the toner was observed even after developing 3,000 plates. Also, the image quality of the images on the offset printing master plate obtained was clear and also the image quality of the 10,000th print was very clear.

Furthermore, when the liquid developer was allowed to stand for 3 months and then the same processing as above was performed using the developer, the results were the same as those of the developer before allowing it to stand.

EXAMPLE 4

In a paint shaker were placed 10 g of poly(decyl methacrylate), 30 g of Isopar H, and 8 g of Alkali Blue together with glass beads followed by dispersing them for 2 hours to obtain a fine dispersion of Alkali Blue.

Then, by diluting 30 g of the white resin dispersion obtained in Production Example 1 of latex grains, 4.2 g of the aforesaid Alkali Blue dispersion, g of a higher alcohol, FOC-1400 (made by Nissan Chemical Industries, Ltd.), and 0.06 g of a semi-docosanylamidated compound of copolymer of diisobutylene and maleic anhydride with one liter of Isopar G, a liquid developer was prepared.

When the liquid developer was applied to the same developing apparatus as in Example 1 for making printing plates, no occurrence of stains of the developing apparatus by sticking of the toner was observed even after developing 3,000 plates. Also, the image quality of the images on the offset printing master plate and the images of the 10,000th print was very clear.

EXAMPLES 5 TO 21

By following the same procedure as Example 4 except that 6.0 g (as solid component) of each of the latex grains shown in Table 8 below were used in place of the white resin dispersion obtained in Production Example 1 of latex grains, each of liquid developers of this invention was prepared.

TABLE 8

| Example No. | Latex Grains | Stains of Developing Apparatus | Image of the 3,000th Plate |
|---|---|---|---|
| 5 | D-2 | No stain occurred | Clear |
| 6 | D-3 | No stain occurred | Clear |
| 7 | D-4 | No stain occurred | Clear |
| 8 | D-5 | No stain occurred | Clear |
| 9 | D-6 | No stain occurred | Clear |
| 10 | D-7 | No stain occurred | Clear |
| 11 | D-8 | No stain occurred | Clear |
| 12 | D-9 | No stain occurred | Clear |
| 13 | D-10 | No stain occurred | Clear |
| 14 | D-11 | No stain occurred | Clear |
| 15 | P-12 | No stain occurred | Clear |
| 16 | P-13 | No stain occurred | Clear |
| 17 | P-14 | No stain occurred | Clear |
| 18 | P-15 | No stain occurred | Clear |
| 19 | P-16 | No stain occurred | Clear |
| 20 | P-17 | No stain occurred | Clear |
| 21 | P-18 | No stain occurred | Clear |

When each liquid developer was applied to the same developing apparatus as in Example 1 for making printing plates, no occurrence of stains of the developing apparatus by sticking of the toner was observed even after developing 3,000 plates. Also, the image quality of each offset printing master plate observed and the images of the 10,000th print were very clear.

EXAMPLE 22

In a paint shaker (manufactured by Tokyo Seiki K. K.) were placed 10 g of a dodecyl methacrylate/acrylic acid copolymer (95/5 by weight ratio), 10 g of nigrosine, and 30 g of Isopar G together with glass beads followed by dispersing for 4 hours to obtain a fine dispersion of nigrosine.

Then, by diluting 30 g of the resin dispersion obtained in Production Example 28 of latex grains, 2.5 g of the aforesaid nigrosine dispersion, 0.07 g of a copolymer of octadecene and octadecylamine semi-maleate, and 15 g of a higher alcohol, FOC-1600 (made by Nissan Chemical Industries, Ltd.) with one liter of Isopar G, a liquid developer for electrostatic photography was prepared.

Comparison Liquid Developers A1, and B1

Two kinds of comparison liquid developers A1 and B1 were prepared by following the aforesaid method using each of the following resin dispersions in place of the resin dispersion used above.

Comparison Liquid Developer A1:

The resin dispersion obtained in Production Example 55 of latex grains were used.

Comparison Liquid Developer B1:

The resin dispersion obtained in Production Example 56 of latex grains were used.

An electrophotographic light-sensitive material, ELP Master II Type (trade name, made by Fuji Photo Film Co., Ltd.) was imagewise-exposed and developed by a full-automatic processor, ELP 404V (trade name, made by Fuji Photo Film Co., Ltd.) using each of the liquid developers. The processing speed was 7 plates/minute. Furthermore, the occurrence of stains of the developing apparatus by sticking of the toners after processing 3,000 plates of ELP Master II Type was checked. The blackened ratio (imaged area) of the duplicated images was determined using 30% original. The results obtained are shown in Table 9 below.

TABLE 9

| Test No. | Liquid Developer | Stains of Developing Apparatus | Image of the 3,000th Plate |
|---|---|---|---|
| 5 | Developer of Example 22 | No toner residue adhered. | Clear |
| 6 | Comparison Developer A1 | Toner residue greatly adhered. | Letter part lost, density of solid black lowered, background portion fogged. |
| 7 | Comparison Developer B1 | Toner residue adhered slightly. | Density of solid black of images lowered, solid black portion partially blurred. |

Test No. 5: Examples of this invention
Test Nos. 6 and 7: Comparison Examples

As is clear from the results shown in Table 9, when printing plates were made using each liquid developer, under the severe plate-making condition as the very high processing (plate-making) speed described above, only the liquid developer of this invention gave the 3,000th printing plate having clear images without staining the developing apparatus.

Then, the offset printing master plate (ELP Master) prepared using each liquid developer was used for printing in a conventional manner, and the number of prints obtained before the occurrences of defects of letters on the images of the prints, the blur of solid black portions, etc., was checked. The results showed that the master plate obtained by using each of the liquid developer of this invention and the comparison liquid developers A1 and B1 gave more than 10,000 prints without accompanied by the aforesaid failures.

As is clear from the aforesaid results, only the liquid developer of this invention could advantageously used for preparing a large number of prints by the master plate without causing stains on the developing apparatus by sticking of the toner.

That is, in the case of using each of the comparison liquid developers A1 and B1, the developing apparatus was too stained to further use continuously although there was no problem on the number of prints.

In the cases of using the comparison liquid developer B1, staining of the developing apparatus was greatly reduced as compared to the case of using the comparison liquid developer Al but when the development condition became severe, a satisfactory result was not yet obtained. That is, it is considered that the known dispersion-stabilizing resin in the comparison liquid developer B1 is a random copolymer wherein the polymerizable double bond group which is copolymerized with the monomer (A) (vinyl acetate in the example) contained in the polymer exists near the polymer main chain in the component containing the polymerizable double bond group, whereby the resin is inferior in the re-dispersibility of the latex grains to the dispersion-stabilizing resin for use in this invention.

EXAMPLE 23

A mixture of 100 g of the white resin dispersion obtained in Production Example 28 of latex grains and 1.5 g of Sumikaron Black was heated to 100° C. and stirred for 4 hours at the temperature. After cooling to room temperature, the reaction mixture was passed through a 200 mesh nylon cloth to remove the remaining dye, whereby a black resin dispersion having a mean grain size of 0.25 μm was obtained.

Then, by diluting 30 g of the aforesaid black resin dispersion, 0.05 g of zirconium naphthenate, and 20 g of a higher alcohol, FOC-1600 (made by Nissan Chemical Industries, Ltd.) with one liter of Shellsol 71, a liquid developer was prepared.

When the liquid developer was applied to the same developing apparatus as in Example 22 for making printing plates, no occurrence of stains of the developing apparatus by sticking of the toner was observed even after developing 3,000 plates.

Also, the image quantity of the offset printing master plate obtained was clear and the images of the 10,000th print were very clear.

EXAMPLE 24

A mixture of 100 g of the white resin dispersion obtained in Production Example 32 of latex grains and 3 g of Victoria Blue B was heated to a temperature of from 70° C. to 80° C. followed by stirring for 6 hours. After cooling to room temperature, the reaction mixture was passed through a 200 mesh nylon cloth to remove the remaining dye, whereby a blue resin dispersion having a mean grain size of 0.25 μm was obtained.

Then, by diluting 32 g of the aforesaid blue resin dispersion, 0.05 g of zirconium naphthenate, and 15 g of a higher alcohol, FOC-1400 (made by Nissan Chemical Industries, Ltd.) with one liter of Isopar H, a liquid developer was prepared.

When the liquid developer was applied to the same developing apparatus as in Example 22 for making printing plates, no occurrence of stains of the developing apparatus by sticking of the toner was observed even after developing 3,000 plates.

Also, the images of the offset printing master plate obtained were clear and the images of the 10,000th print were very clear.

EXAMPLE 24

A mixture of 100 g of the white resin dispersion obtained in Production Example 32 of latex grains and 3 g of Victoria Blue B was heated to a temperature of from 70° C. to 80° C. followed by stirring for 6 hours. After cooling, the reaction mixture was passed through a 200 mesh nylon cloth to remove the remaining dye, whereby a blue resin dispersion having a mean grain size of 0.25 μm was obtained.

Then, by diluting 32 g of the aforesaid blue resin dispersion, 0.05 g of zirconium naphthenate, and 15 g of a higher alcohol, FOC-1400 (made by Nissan Chemical Industries, Ltd.) with one liter of Isopar H, a liquid developer was prepared.

When the liquid developer was applied to the same developing apparatus as in Example 22 for making printing plates, no occurrence of stains of the developing apparatus by sticking of the toner was observed even after developing 3,000 plates.

Also, the image quality of the offset printing master plate obtained were clear and the images of the 10,000th print were very clear.

Furthermore, when the liquid developer was allowed to stand for 3 months and the used for the same processing as above, the results obtained were almost same as above.

EXAMPLE 25

In a paint shaker were placed 10 g of poly(decyl methacrylate), 30 g of Isopar H, and 8 g of Alkali Blue together with glass beads followed by dispersing them for 2 hours to provide a fine dispersion of Alkali Blue.

Then, by diluting 30 g of the white resin dispersion obtained in Production Example 28 of latex grains, 4.2 g of the aforesaid Alkali Blue, 15 g of a higher alcohol, FOC-1400 (made by Nissan Chemical Industries, Ltd.), and 0.06 g of a semi-docosanylamide compound of copolymer of diisobutylene and maleic anhydride with one liter of Isopar G, a liquid developer was prepared.

When the liquid developer was applied to the same developing apparatus as in Example 22 for making printing plates, no occurrence of stains of the developing apparatus by sticking of the toner was observed even after developing 3,000 plates.

Also, the image quality of the images on the offset master plate and images of the 10,000th print were very clear.

EXAMPLES 26 TO 42

By following the same procedure as Example 25 except that 6.0 g (as a solid content ) of each of the latex grains shown in Table 10 were used in place of the white resin dispersion produced in Production Example 28 of latex grains, each of liquid developers was prepared.

TABLE 10

| Example No. | Latex Grains | Stains of Developing Apparatus | Image of the 3,000th Plate |
|---|---|---|---|
| 26 | D-29 | No stain occurred | Clear |
| 27 | D-30 | No stain occurred | Clear |
| 28 | D-31 | No stain occurred | Clear |
| 29 | D-32 | No stain occurred | Clear |
| 30 | D-33 | No stain occurred | Clear |
| 31 | D-34 | No stain occurred | Clear |
| 32 | D-35 | No stain occurred | Clear |
| 33 | D-36 | No stain occurred | Clear |
| 34 | D-37 | No stain occurred | Clear |

TABLE 10-continued

| Example No. | Latex Grains | Stains of Developing Apparatus | Image of the 3,000th Plate |
|---|---|---|---|
| 35 | D-38 | No stain occurred | Clear |
| 36 | P-39 | No stain occurred | Clear |
| 37 | P-40 | No stain occurred | Clear |
| 38 | P-41 | No stain occurred | Clear |
| 39 | P-42 | No stain occurred | Clear |
| 40 | P-43 | No stain occurred | Clear |
| 41 | P-44 | No stain occurred | Clear |
| 42 | P-45 | No stain occurred | Clear |

When each of the liquid developer was applied to the developing apparatus as in Example 22, no occurrence of stains of the developing apparatus by sticking of the toner was observed even after developing 3,000 plates.

Also, the image quality of each offset printing master plate obtained and the images of the 10,000th prints obtained in each case were very clear.

EXAMPLE 43

In a paint shaker (manufactured by Tokyo Seiki K. K.) were placed 10 g of a dodecyl methacrylate/acrylic acid copolymer (95/5 by weight ratio), 10 g of nigrosine, and 30 g of Isopar G together with glass beads followed by dispersing for 4 hours to obtain a fine dispersion of nigrosine.

Then, by diluting 30 g of the resin dispersion produced in Production Example 57 of latex grains, 2.5 g of the aforesaid nigrosine dispersion, 0.07 g of a copolymer of octadecene and octadecylamine semi-maleate, and 15 g of a higher alcohol, FOC-1600 (made by Nissan Chemical Industries, Ltd.) with one liter of Isopar G, a liquid developer was prepared.

Comparison Liquid Developers R'-1, R'-2, and R'-3

Three kinds of comparison liquid developers R'-1, R'-2, and R'-3 were prepared in the same manner as above except that each of the resin dispersions (latex grains) shown below was used in place of the aforesaid resin dispersion.

Comparison Liquid Developer R'-1:

The resin dispersion obtained in Production Example 80 of latex grains were used.

Comparison Liquid Developer R'-2:

The resin dispersion obtained in Production Example 81 of latex grains were used.

Comparison Liquid Developer R'-3:

The resin dispersion obtained in Production Example 82 of latex grains were used.

An electrophotographic light-sensitive material, ELP Master II Type (trade name, made by Fuji Photo Film Co., Ltd.) was imagewise exposed and developed by a full-automatic processor, ELP 404V (trade name, made by Fuji Photo Film Co., Ltd.) using each of the liquid developers thus prepared. The processing (plate-making) speed was 7 plates/minute. Furthermore, after processing 3,000 plates of ELP master II Type, the occurrence of stains of the developing apparatus by sticking of the toner was observed. The blackened ratio (imaged area) of the duplicated images was determined using 30% original. The results obtained are shown in Table 11 below.

TABLE 11

| Test No. | Liquid Developer | Stains of Developing Apparatus | Image of the 3,000th Plate |
|---|---|---|---|
| 8 | Developer of Example 43 | No toner residue adhered. | Clear |
| 9 | Comparison Developer R'-1 | Toner residue greatly adhered. | Letter part lost, density of solid black lowered, background portion fogged. |
| 10 | Comparison Developer R'-2 | Toner residue adhered slightly. | Density of solid black of images lowered, solid black portion partially blurred. |
| 11 | Comparison Developer R'-3 | Toner residue adhered slightly. | Clear |

Test No. 8: Examples of this invention
Test Nos. 9 to 11: Comparison Examples

As is clear from the results shown in Table 11, when printing plates were made using each liquid developer under the severe plate-making condition as the very high processing speed described above, the only liquid developer of this invention gave the 3,000th printing plate having clear images without causing stains of the developing apparatus.

Then, the offset printing master plate (ELP Master) prepared using each liquid developer was used for printing in a conventional manner, and the number of prints obtained before the occurrences of defects of letters on the images of t prints, the blur of solid black portions, etc., was checked. The results showed that the master plate obtained using each of the liquid developer of this invention and the comparison liquid developers R'-1, R'-2, and R'-3 gave more than 10,000 prints without accompanied by the aforesaid failures.

As is clear from the aforesaid results, only the liquid developer of this invention could be advantageously used for preparing a large number of prints by the master plate without causing stains on the developing apparatus by sticking of the toner.

That is, in the case of, using each of the comparison liquid developers R'-1, R'-2, and R'-3, the developing apparatus was too stained for further use continuously although there was no problem with the number of prints.

In the cases of using the comparison liquid developers R'-2 and R'-3, staining of the developing apparatus was greatly reduced as compared to the case of using the comparison liquid developer R'-1 but when the development condition became severe, a satisfactory result was not yet obtained. That is, it is considered that the known dispersion-stabilizing resin (R-2) in the comparison liquid developer R'-2 is a random copolymer wherein the polymerizable double bond group which is copolymerized with the monomer (A) (vinyl acetate in the example) contained in the polymer exists near the polymer main chain in the component containing the polymerizable double bond group, whereby the resin is inferior in the re-dispersibility of the latex grains to the dispersion-stabilizing resin for use in this invention.

Also, the dispersion-stabilizing resin (R-3) in the comparison liquid developer R'-3 has a chemical structure that the sum of the atoms of the linkage group of linking the polymerizable double bond group in the resin, which is copolymerized with the monomer (A), to the polymer main chain portion in the resin is at least 9 and further, as compared to that the structure of the polymerizable double bond group in the comparison liquid developer R'-2 is $$CH_2{=}\overset{\overset{\displaystyle CH_3}{|}}{C}{-}COO{-},$$

the polymerizable double bond group in the comparison liquid developer R'-3 is $CH_2{=}CH{-}OCO{-}$, which shows preferably a good reactivity with vinyl acetate (monomer (A)). Thus, the images of the 3,000th printing plate were clear, which showed a great improvement over the case of the comparison liquid developer R'-2. However, even in the case of the comparison liquid developer R'-3, when the development condition was severe, staining of the developing apparatus was yet unsatisfactory.

EXAMPLE 44

A mixture of 100 g of the white resin dispersion obtained in Production Example 57 of latex grains and 1.5 g of Sumikalon Black was heated to 100° C. followed by stirring for 4 hours. After cooling, the reaction mixture was passed through a 200 mesh nylon cloth to remove the remaining dye, whereby a black resin dispersion having a mean grain size of 0.25 μm was obtained.

Then, by diluting 30 g of the aforesaid black resin dispersion, 0.05 g of zirconium naphthenate, and 20 g of a high alcohol, FOC-1600 (made by Nissan Chemical Industries, Ltd.) with one liter of Shellsol 71, a liquid developer was prepared.

When the liquid developer was applied to the developing apparatus as in Example 43 for making printing plates, no occurrence of stains of the developing apparatus by sticking of the toner was observed even after developing 3,000 plates.

Also, the image quantity of the offset printing master plate obtained was clear and images of the 10,000th prints were very clear.

EXAMPLE 45

A mixture of 100 g of the white resin dispersion obtained in Production Example 77 of latex grains and 3 g of Victoria Blue was heated to a temperature of from 70° C. to 80° C. followed by stirring for 6 hours. After cooling to room temperature, the reaction mixture was passed through a 200 mesh nylon cloth to remove the remaining dye, whereby a black resin dispersion having a mean grain size of 0.25 μm was obtained.

Then, by diluting 32 g of the aforesaid blue resin dispersion, 0.05 g of zirconium naphthenate, and 15 g of a higher alcohol, FOC-1400 (made by Nissan Chemical Industries, Ltd.) with one liter of Isopar H, a liquid developer was prepared.

When the liquid developer was applied to the developing apparatus as in Example 43, no occurrence of stains of the developing apparatus by sticking of the toner was observed even after developing 3,000 plates.

Also, the image quality of the offset printing master plate obtained was clear and the images of the 10,000th print was were clear.

Furthermore, when the liquid developer was allowed to stand for 3 months and used for the processing as above, the results obtained were almost same as above.

EXAMPLE 46

In a paint shaker were placed 10 g of poly(decyl methacrylate), 30 g of Isopar H, and 8 g of Alkali Blue together with glass beads followed by dispersing for 2 hours to provide a fine dispersion of Alkali Blue.

Then, by diluting 30 g of the white resin dispersion obtained in Production Example 57 of latex grains, 4.2 g of the aforesaid Alkali Blue dispersion, 15 g of a higher alcohol, FOC-1400 (made by Nissan Chemical Industries, Ltd.), and 0.06 g of a semi-docosanylamidated product of copolymer of diisobutylene and maleic anhydride with one liter of Isopar G, a liquid developer was prepared.

When the liquid developer was applied to the developing apparatus as in Example 43 for making printing plates, no occurrence of stains of the developing apparatus by sticking of the toner was observed even after developing 3,000 plates.

Also, the image quality of the offset printing master plate obtained and the images of the 10,000th print was very clear.

EXAMPLES 47 TO 63

By following the same procedure as Example 46 except that 6.0 g (as solid component) of each of the latex grains shown in Table 12 below were used in place of the white resin dispersion obtained in Production Example 57 of latex grains, each of liquid developers was prepared.

TABLE 12

| Example No. | Latex Grains | Stains of Developing Apparatus | Image of the 3,000th Plate |
|---|---|---|---|
| 47 | D-58 | No stain occurred | Clear |
| 48 | D-59 | No stain occurred | Clear |
| 49 | D-60 | No stain occurred | Clear |
| 50 | D-61 | No stain occurred | Clear |
| 51 | D-62 | No stain occurred | Clear |
| 52 | D-63 | No stain occurred | Clear |
| 53 | D-64 | No stain occurred | Clear |
| 54 | D-65 | No stain occurred | Clear |
| 55 | D-66 | No stain occurred | Clear |
| 56 | D-67 | No stain occurred | Clear |
| 57 | D-68 | No stain occurred | Clear |
| 58 | D-69 | No stain occurred | Clear |
| 59 | D-70 | No stain occurred | Clear |
| 60 | D-71 | No stain occurred | Clear |
| 61 | D-72 | No stain occurred | Clear |
| 62 | D-73 | No stain occurred | Clear |
| 63 | D-74 | No stain occurred | Clear |

When each of the liquid developer was applied to the same developing apparatus as in Example 43 for making printing plates, no occurrence of stains of the developing apparatus by sticking of the toner was observed even after developing 3,000 plates.

Also, the image quality of the offset printing master plate obtained and the images of the 10,000th print were very clear.

While the invention has been described in detail and with reference to specific embodiments thereof, it will be apparent to one skilled in the art that various changes and modifications can be made therein without departing from the spirit and scope thereof.

What is claimed is:

1. A liquid developer for electrostatic photography comprising at least resin grains dispersed in a non-aqueous solvent having an electric resistance of at least $10^9$ Ωcm and a dielectric constant of not higher than 3.5, wherein the dispersed resin grains are polymer resin grains obtained by polymerizing a solution containing at least a monofunctional monomer (A) which is soluble in the aforesaid non-aqueous solvent, but becomes insoluble therein by being polymerized in the presence of a dispersion-stabilizing resin (BA) soluble in the non-aqueous solvent, which is a polymer containing a recurring unit represented by the following formula (I) and having no graft group which is polymerizable with said monofunctional monomer (A), at least a part of the main chain of the polymer being crosslinked:

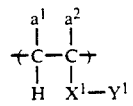

(I)

wherein $X^1$ represents —COO—, —OCO—, —$CH_2$OCO—, —$CH_2$COO—, —O—, or —$SO_2$—; $Y^1$ represents an aliphatic group having from 6 to 32. carbon atoms; and $a^1$ and $a^2$, which may be the same or different, each represents a hydrogen atom, a halogen atom, a cyano group, a hydrocarbon group having from 1 to 8 carbon atoms, —COO—$Z^1$ or —COO—$Z^1$ bonded via a hydrocarbon group having from 1 to 8 carbon atoms (wherein $Z^1$ represents a hydrocarbon group having from 1 to 22 carbon atoms).

2. The liquid developer for electrostatic photography as in claim 1, wherein the dispersed resin grains are copolymer resin grains obtained by polymerizing a solution containing at least one kind of the mono-functional monomer (A) which is soluble in the non-aqueous solvent but becomes insoluble therein by being polymerized and at least one kind of a monomer (B-1) represented by following formula (II-I), said monomer having at least two polar groups and/or polar linkage groups;

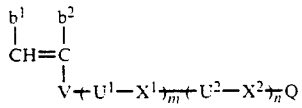

(II-1)

wherein V represents —O—, —COO—, —OCO—, —$CH_2$OCO—, —$SO_2$—, —CONH—, —$SO_2$NH—,

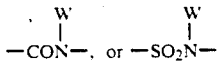

(wherein W represents a hydrocarbon group or has the same meaning as —$U^1$—$X^1$—$_m$$U^2$—$X^2$—$_n$Q in the linkage group of formula (II-1); Q represents a hydrogen atom or a hydrocarbon group having from 1 to 18 carbon atoms, which may be substituted by a halogen atom, —OH, —CN, —$NH_2$, —COOH, —$SO_3$H, or —$PO_3H_2$; $X^1$ and $X^2$, which may be the same or different, each represents —O—, —S—, —CO—, —$CO_2$—, —OCO—, —$SO_2$—,

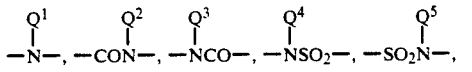

—$NHCO_2$—, or —NHCONH— (wherein $Q^1$, $Q^2$, $Q^3$, $Q^4$, and $Q^5$ have the same meaning as Q described above); $U^1$ and $U^2$, which may be the same or different, each represents a hydrocarbon group having from 1 to 18 carbon atoms which may be substituted or may contain

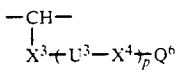

(wherein $X^3$ and $X^4$, which may be the same or different, have the same meaning as $X^1$ and $X^2$ described above; $U^4$ represents a hydrocarbon group having from 1 to 18 carbon atoms, which may be substituted; and $Q^6$ has the same meaning as Q) in the main chain bond; $b^1$ and $b^2$, which may be the same or different, each represents a hydrogen atom, a hydrocarbon group, —COO—$R^1$, —COO—$R^1$ bonded via a hydrocarbon group (wherein $R^1$ represents a hydrogen atom or a hydrocarbon group which may be substituted); and m, n and p, which may be the same or different, each represents an integer of from 0 to 4.

3. The liquid developer for electrostatic photography as claim 2, wherein the proportion of said monomer (B-1) is from 0.1 to 10% by weight based on the amount of the monofunctional monomer (A).

4. The liquid developer for electrostatic photography as in claim 1, wherein the dispersed resin grains are copolymer resin grains obtained by polymerizing a solution containing at least one kind of the mono-functional monomer (A) which is soluble in the non-aqueous solvent but becomes insoluble therein by being polymerized and at least one kind of a monomer (B-2) represented by the following formula (II-2), said monomer having an aliphatic group having at least 8 carbon atoms and forming a copolymer by the polymerization reaction with the aforesaid monomer (A);

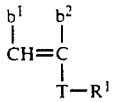

(II-2)

wherein $R^1$ represents an aliphatic group having at least 8 carbon atoms; T represents —COO—, —CONH,

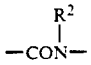

(wherein $R^2$ represents an aliphatic group), —OCO—, —$CH_2$COO—, or —O—; and $b^1$ and $b^2$, which may be the same or different, each represents a hydrogen atom, an alkyl group, —$COOR^3$, or —$CH_2$—$COOR^3$ (wherein $R^3$ represents an aliphatic group).

5. The liquid developer for electrostatic photography as in claim 4, wherein the proportion of said monomer (B-2) is from 0.1 to 20% by weight based on the amount of the monofunctional monomer (A).

6. The liquid developer for electrostatic photography as in claim 1, wherein the content of the component having a recurring unit of formula (I) in said dispersion-stabilizing resin (BA) is at least 30% by weight based on the total components of the polymer of the resin (BA).

7. The liquid developer for electrostatic photography as in claim 1, wherein the dispersion-stabilizing resin (BA) has a weight average molecular weight of from $1\times10^4$ to $2\times10^5$.

8. The liquid developer for electrostatic photography as in claim 1, wherein said liquid developer further contains a colorant.

9. The liquid developer for electrostatic photography as in claim 1, wherein said monofunctional monomer (A) is represented by formula (II):

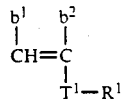

(II)

wherein $T^1$ represents —COO—, —OCO—, —$CH_2$OCO—, —$CH_2$COO—, —O—,

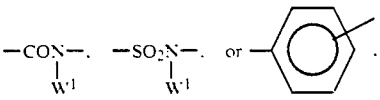

wherein $W^1$ represents a hydrogen atom or an aliphatic group having from 1 to 18 carbon atoms, which may be substituted;

$R^1$ represents an aliphatic group having from 1 to 6 carbon atoms which may be substituted; and $b^1$ and $b^2$, which may be the same or different, each represents the same group as $a^1$ or $a^2$ in formula (I).

* * * * *